US009480618B2

(12) United States Patent
Hsiao-Wecksler et al.

(10) Patent No.: US 9,480,618 B2
(45) Date of Patent: Nov. 1, 2016

(54) PORTABLE ACTIVE PNEUMATICALLY POWERED ANKLE-FOOT ORTHOSIS

(76) Inventors: Elizabeth T. Hsiao-Wecksler, Urbana, IL (US); K. Alex Shorter, Urbana, IL (US); Vito Gervasi, Milwaukee, WI (US); Douglas L. Cook, Milwaukee, WI (US); Richard Remmers, Milwaukee, WI (US); Geza F. Kogler, Springfield, IL (US); William K. Durfee, Edina, MN (US)

( * ) Notice: Subject to any disclaimer, the term of this patent is extended or adjusted under 35 U.S.C. 154(b) by 1174 days.

(21) Appl. No.: 13/419,958

(22) Filed: Mar. 14, 2012

(65) Prior Publication Data

US 2012/0289870 A1 Nov. 15, 2012

Related U.S. Application Data

(63) Continuation-in-part of application No. 12/898,519, filed on Oct. 5, 2010, now abandoned.

(60) Provisional application No. 61/452,523, filed on Mar. 14, 2011.

(51) Int. Cl.
*A61H 1/02* (2006.01)
*A61H 3/00* (2006.01)

(52) U.S. Cl.
CPC ..... *A61H 1/0266* (2013.01); *A61H 3/00* (2013.01); *A61H 2201/165* (2013.01); *A61H 2201/5041* (2013.01); *A61H 2201/5061* (2013.01); *A61H 2201/5069* (2013.01); *A61H 2201/5071* (2013.01)

(58) Field of Classification Search
CPC ..... A61H 1/0266; A61H 3/00; A61H 2201/165; A61H 1/0237; A61H 1/0262; A61F 2/66; A61F 2002/74; A61F 2002/747; A61F 2002/748
See application file for complete search history.

(56) References Cited

U.S. PATENT DOCUMENTS

| | | | | |
|---|---|---|---|---|
| 3,639,092 A * | 2/1972 | Sauvaget | F04C 2/3446 | 418/175 |
| 5,170,777 A * | 12/1992 | Reddy | A61H 1/0274 | 482/44 |
| 5,215,508 A * | 6/1993 | Bastow | A63B 23/08 | 482/112 |
| 5,961,541 A * | 10/1999 | Ferrati | A61F 5/0102 | 434/307 R |
| 7,628,766 B1 * | 12/2009 | Kazerooni | A61F 5/00 | 601/35 |
| 2006/0069336 A1 * | 3/2006 | Krebs | A61H 1/0266 | 602/28 |
| 2006/0211956 A1 * | 9/2006 | Sankai | A61B 5/04888 | 601/5 |

(Continued)

OTHER PUBLICATIONS

Au et al. Powered ankle-foot prosthesis to assist level-ground and stair-descent gaits. Neural Networks, Mar. 7, 2008. Elsevier, p. 654-666.*

(Continued)

*Primary Examiner* — Justine Yu
*Assistant Examiner* — Christopher Miller
(74) *Attorney, Agent, or Firm* — Greer, Burns & Crain, Ltd.

(57) ABSTRACT

A portable active fluid-powered ankle foot orthosis. A lower leg mount and a foot bed are pivotally coupled at or proximate to an ankle position. A fluid powered rotary actuator is configured to receive power from a wearable fluid power source and provide controlled force and resistance to aid or inhibit relative rotation of the foot bed and the lower leg mount. An integral controller is provided for receiving data from sensors and controlling the fluid powered rotary actuator to actively assist gait of a user.

17 Claims, 23 Drawing Sheets

(56) References Cited

U.S. PATENT DOCUMENTS

| | | | | |
|---|---|---|---|---|
| 2007/0049858 | A1* | 3/2007 | Agrawal | A61F 5/0127 602/27 |
| 2007/0056592 | A1* | 3/2007 | Angold | A61H 3/00 128/845 |
| 2007/0156252 | A1* | 7/2007 | Jonsson | A61F 2/66 623/24 |
| 2007/0249457 | A1* | 10/2007 | Tesar | B64C 13/34 475/180 |
| 2009/0222105 | A1* | 9/2009 | Clausen | A61F 2/60 623/27 |
| 2010/0094185 | A1* | 4/2010 | Amundson | A61F 5/0102 602/16 |
| 2011/0112447 | A1 | 5/2011 | Hsiao-Wecksler | |
| 2011/0166489 | A1* | 7/2011 | Angold | A61H 1/0255 601/34 |

OTHER PUBLICATIONS

A. M. Dollar and H. Herr, "Lower extremity exoskeletons and active orthoses: challenges and state-of-the-art," Robotics. IEEE Transactions on. vol. 24, pp. 144-158, 2008.

S. Yamamoto, M. Ebina, S. Kubo, T. Hayashi, Y. Akita, and Y. Hayakawa, "Development of an ankle-foot orthosis with dorsiflexion assist, part 2: structure and evaluation," Journal of Prosthetics and Orthotics, vol. II, pp. 24-28, 1999.

R. Chin, E. T. Hsiao-Wecksler, E. Loth, G. Kogler, S. D. Manwaring, S.N. Tyson, K. A. Shorter, and J. N. Gilmer, "A pneumatic power harvesting ankle-foot orthosis to prevent foot-drop," Journal of NeuroEngineering and Rehabilitation, vol. 6, 2009.

H. Hirai, R. Ozawa, S. Goto, H. Fujigaya, S. Yamasaki, Y. Hatanaka, and A. Kawamura, "Development of an ankle-foot orthosis with a pneumatic passive element," In the 15th IEEE International Symposium on Robot and Human Interactive Communication, Hatfield, UK, 2006, pp. 220-225.

M. Takaiwa and T. Noritsugu, "Development of pneumatic walking support shoes using potential energy of human," in 7th JFPS International Symposium on Fluid Power, Toyama, Japan, 2008, pp. 781-786.

O. Yokoyama, H. Sashika. A. Hagiwara, S. Yamamoto, and T. Yasui, "Kinematic effects on gait of a newly designed ankle-foot orthosis with oil damper resistance: A case series of 2 patients with hemiplegia," Archives of Physical Medicine and Rehabilitation, vol. 86, pp. 162-166, 2005.

J. Furusho, T. Kikuchi, M. Tokuda, T. Kakehashi, K. Ikeda, S. Morimoto, Y. Hashimoto, H. Tomiyama, A. Nakagawa, and Y. Akazawa, "Development of shear type compact MR brake for the intelligent ankle-foot orthosis and its control; research and development in NEDO for practical application of human support robot." in IEEE 10th International Conference on Rehabilitation Robotics, 2007, Noordwijk, the Netherlands, 2007, pp. 89-94.

J. A. Blaya and H. Herr, "Adaptive control of a variable-impedance ankle-foot orthosis to assist drop-foot gait," Neural Systems and Rehabilitation Engineering, IEEE Transactions on, vol. 12, pp. 24-31, 2004.

A. W. Boehler, K. W. Hollander, T. G. Sugar, and D. Shin, "Design, implementation and test results of a robust control method for a powered ankle foot orthosis CAFO)," in IEEE International Conference on Robotics and Automation, 2008. ICRA 2008, 2008, pp. 2025-2030.

D. P. Ferris, J. M. Czerniecki, and B. Hannaford, "An ankle-foot orthosis powered by artificial pneumatic muscles," Journal of Applied Biomechanics, vol. 21, pp. 189-197, 2005.

M. Noel, B. Cantin, S. Lambert, C. M. Gosselin, and L. J. Bouyer, "An electrohydraulic actuated ankle foot orthosis to generate force fields and to test proprioceptive reflexes during human walking," Neural Systems and Rehabilitation Engineering, IEEE Transactions on, vol. 16, pp. 390-399,2008.

K. Bharadwaj, T. G. Sugar, J. B. Koeneman, and E. J. Koeneman, "Design of a robotic gait trainer using spring over muscle actuators for ankle stroke rehabilitation," vol. 127, 2005.

A. Roy, H. 1. Krebs, S. L. Patterson, T. N. Judkins, I. Khanna, L. W. Forrester, R. M. Macko, and N. Hogan, "Measurement of human ankle stiffness using the Anklebot," in IEEE 10th International Conference on Rehabilitation Robotics, 2007. ICORR 2007, Noordwijk, The Netherlands, 2007, pp. 356-363.

H. I. Krebs and N. Hogan, "Therapeutic robotics: a technology push," Proceedings of the IEEE, vol. 94, pp. 1727-1738, Sep. 2006.

W. Durfee and Z. Sun, "Fluid power system dynamics," University of Minnesota, 2009.

A. Beasley, Fluid Power: Naval Education and Training Program Management Support Activity, 1990.

S. Yamamoto, A. Hagiwara, T. Mizobe, O. Yokoyama, and T. Yasui, "Development of an ankle—foot orthosis with an oil damper," Prosthetics and Orthotics International, vol. 29, pp. 209-219, 2005.

L. Tian, D. Kittelson, and W. Durfee, "Miniature HCCI free-piston engine compressor for orthosis application," in Proceedings of the 15th Small Engine Technology Conference, 2009.

Krebs, H., et al., "A paradigm shift for rehabilitation robotics," Eng. Med. Biol. Mag, IEEE, 2008.

CCEFP 4$^{th}$ Annual Report, vol. 2, Mar. 16, 2010.

Remmers, Richard, et al., "Use of Additive Manufacturing to Create Functional Fluid Power Component" CCEFP Annual Meeting, Purdue University, Jun. 14-15, 2010, 1 page.

* cited by examiner

PORTABLE ACTIVE PNEUMATICALLY POWERED ANKLE-FOOT ORTHOSIS

PRIORITY CLAIM

This application claims the benefit of U.S. Provisional Application Ser. No. 61/452,523, filed Mar. 14, 2011, under 35 U.S.C. §119. This application is a continuation-in-part of U.S. patent application Ser. No. 12/898,519, filed Oct. 5, 2010.

STATEMENT OF GOVERNMENT INTEREST

This invention was made with Government support under Contract No. 0540834 awarded by the National Science Foundation. The Government has certain rights in the invention.

FIELD OF THE INVENTION

A field of the invention is orthotics.

BACKGROUND OF THE INVENTION

During normal gait, the ankle joint, shank, and foot play important roles in all aspects of locomotion, including shock absorption, stance stability, energy conservation and propulsion. For example, FIG. 1 shows foot 10 and ankle joint 12 movement during part of normal gait. A gait cycle is typically defined from the initial contact of the heel 14 to the following heel contact. At the initiation of the gait cycle, impact forces are dissipated when energy is absorbed by the soft tissues at the heel 14 as the foot 10 comes into contact with the ground 16. Additionally, the muscles and tendons of the ankle joint complex act as an energy-dissipating brake to control the deceleration of the foot 10 before full contact with the ground 16 at foot-flat. The ankle joint complex also helps to maintain stability during stance phase. This is particularly important during the single support part of the stance phase, when the contralateral limb is swinging and only one limb is supporting the body. In addition to providing stability, energy is stored in the stretching of tendons and muscles of the ankle joint complex when the shank 18 pivots. The plantarflexion torque generated at the ankle 12 at push-off results in the highest power output for any joint during walking and is the primary source of power for forward propulsion.

Pathology or injury that affects the ankle joint can significantly impact quality of life by impairing some or all functional aspects of gait. Both dorsiflexor and plantarflexor muscle groups of the ankle-foot complex are critical to normal walking, and undesirable compensatory gait patterns result from weakened or impaired muscles of either type. Other causes of lower limb gait deficiencies include, but are not limited to, trauma, incomplete spinal cord injuries, stroke, multiple sclerosis, muscular dystrophies, and cerebral palsy.

The dorsiflexors (e.g., shin muscles) lie anterior to the ankle joint and include the tibialis anterior, extensor digitorum longus, and extensor hallucius longus. Weak dorsiflexors affect both stance and swing phases of gait, causing clearance issues during swing phase and uncontrolled deceleration of the foot at initial stance. Swing is affected because the foot does not effectively clear the ground due to weak or absent dorsiflexor muscles, which results in a steppage-type gait pattern that is commonly called foot drop. Steppage gait is a compensatory walking pattern characterized by increased knee and hip flexion during the swing phase so that the toe clears the ground during walking. The weak or absent dorsiflexors also prevent the controlled deceleration of the foot shortly after heel strike. This lack of control results in an often audible foot slap that impacts stance initialization.

The plantarflexors (e.g., calf muscles) lie posterior to the ankle joint and include the gastrocnemius, soleus, and the peroneal and posterior tibial muscles. From heel strike to middle stance, the ankle plantarflexors concentrically contract to stabilize the knee and ankle and restrict forward rotation of the tibia. At the end of stance, the plantarflexors concentrically contract and generate torque that accelerates the leg into swing and contributes to forward progression.

Weak plantarflexors primarily affect stance phase by reducing stability and propulsive power of the individual, particularly during limb support. Individuals with impaired ankle plantarflexors compensate by reducing walking speed and shortening contralateral step length. Reduced walking speed results in a corresponding reduction in torque needed for forward progression. The shortened contralateral step is thought to increase stability by limiting anterior movement of the center of pressure with respect to the ankle. Impaired individuals may maintain a fast walking pace by using their hip flexors to compensate for weak plantarflexor muscles.

Ankle foot orthoses (also referred to herein as orthoses or AFOs) can be used to ameliorate the impact to gait of impairments and injuries to the lower limb neuromuscular motor system. AFOs can be used for rehabilitation, diagnostic, or training devices, for example, to assist walking function, direct measurement of joint motion and force, and to perturb gait. Existing technologies for AFOs include passive devices with fixed and articulated joints with or without spring assist, semi-active devices that modulate the spring or damping about the joint, and active devices with various technologies to produce power and to move the joint.

Passive devices generally limit the foot angle to the neutral position (i.e., 90° between leg and foot), which can produce an unnatural gait but prevents further damage or injury and provides limited mobility to people that use them. Passive orthoses do not provide direct assistance during the propulsive phase of gait. Commercial passive devices improve gait deficiencies using motion control. The control of passive AFO elements relies on the activation of springs, valves, or switches in an open-loop manner as the individual walks. This type of AFO has limited robustness and does not adapt to changing walking conditions.

Semi-active devices can store energy, such as in a spring, and provide braking assistance but do not add energy into the system to aid propulsion. Active devices provide assistance in propulsive movements necessary for normal gait. Particular active devices that provide assistance in propulsive phases of gait have been developed for clinical or laboratory settings and are tethered to power sources. Such devices cannot be used outside the clinic or laboratory. Typical active and semi-active devices use large electromechanical actuators that are cumbersome and unattractive.

Compactness and weight are critical to daily use, and current commercial orthoses are all passive as a result. These include passive articulated or non-articulated orthoses, which are made from materials including metal and leather systems, thermoplastics, composites, and hybrid systems. Traditional metal and leather systems have articulated hinge joints with various types of mechanical steps used to limit motion. Some orthoses include springs to resist or assist movement. Common passive devices inhibit motion at undesirable times. Common and more newly developed semi-active devices can also stop or resist motion at undesirable points and only store energy provided by a user, which may not be ideal for treating many gait impairments.

SUMMARY OF THE INVENTION

Embodiments of the present invention provide, among other things, a portable active pneumatically-powered ankle foot orthosis. An example device comprises a lower leg mount and a foot bed pivotally coupled to the lower leg mount at or proximate to an ankle position. A pneumatically powered rotary actuator is configured to receive power from a portable (e.g., wearable) fluid power source and provide controlled force and/or resistance to aid or inhibit relative rotation of the foot bed and the lower leg mount. Embedded sensors are used to provide feedback from the orthosis to actively assist gait of a user.

Additional embodiments of the invention provide a portable active pneumatically powered ankle foot orthosis comprising a lower leg mount, a foot bed pivotally coupled to the lower leg mount at or proximate to an ankle position, and at least one sensor for determining a phase of a user's gait. A pneumatically powered rotary actuator is coupled to the leg mount and to the foot bed. The rotary actuator is configured to receive power from a wearable fluid power source and to provide controlled force and/or resistance to aid or inhibit relative rotation of the foot bed and the lower leg mount. At least one valve is integrated with the rotary actuator. A controller is provided for receiving data from the at least one sensor and controlling the pneumatically powered rotary actuator by controlling the at least one valve to actively assist gait of a user. Preferably, the actuator and the controller are both disposed on a support structure to provide a subassembly integrating the actuator, controller, and valve (s). This subassembly can be coupled to the leg mount.

DETAILED DESCRIPTION

Figure 1:
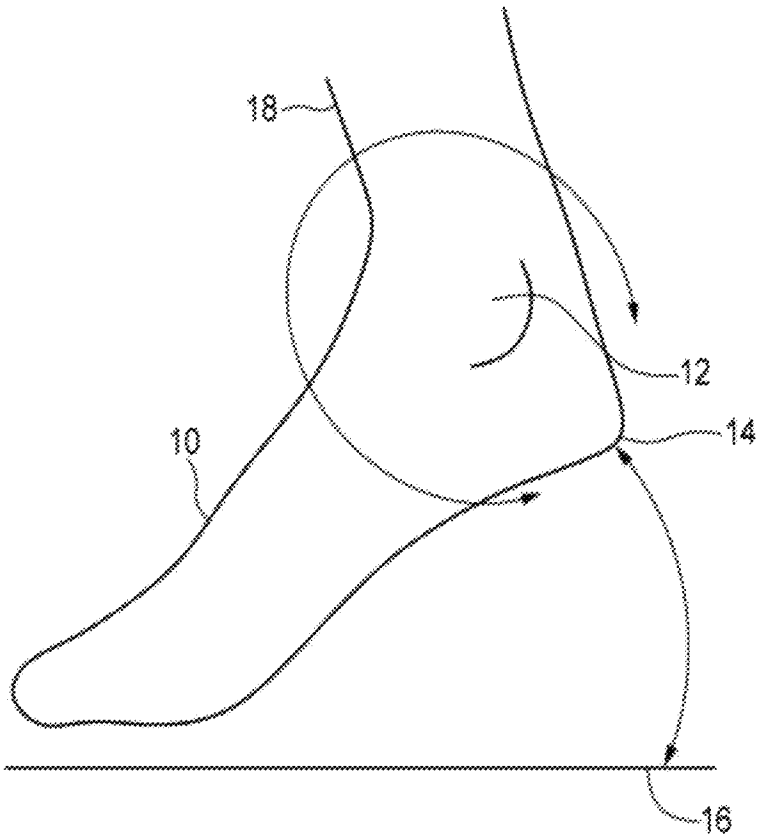
FIG. 1 shows motion of a heel and an ankle joint during a portion of normal gait.

Embodiments of the invention provide a portable active pneumatically powered ankle foot orthosis. Example devices of the invention are pneumatically powered by a self-contained and portable (e.g., wearable) fluid power source, such as a container (e.g., bottle, cylinder, cartridge, etc.) of $CO_2$ or other suitable fluid. $CO_2$ containers that may be used include, as nonlimiting examples, containers used in the power tool industry. The $CO_2$ or other fluid container can be worn on a belt or another area of the body. The fluid power source is coupled to a rotary actuator at or proximate to the ankle joint that is controlled by an on-board controller, e.g., a microcontroller having a microprocessor and memory. The torque generated by the actuator can be used for both motion control of the foot and to provide supplemental torque for the individual during gait.

A compact and lightweight structure attaches to the lower leg of a user, for instance around the leg, to provide a lower leg mount, and a pivotally attached foot bed attaches to the user's foot. The foot bed includes at least one sensor for determining a stage during gait, such as one or more force sensors that communicate with the on-board controller. A rotational sensor preferably monitors the angle between foot and lower leg and also communicates with the on-board controller. Pressure regulators can be used in example embodiments to manage the torque produced by the rotary actuator, and valves can be used to control the actuator by directing the fluid power to the actuator. Control and sensing of the actuator are accomplished through use of the force and/or angle sensor, as well as the on-board controller. In an example operation, the pneumatically powered rotary actuator provides active assistance under direction of the on-board controller via fluid control valves based upon information that the controller receives from the force sensors to provide active ankle torque assistance, either dorsiflexor torque or plantarflexor torque.

Advantageously, in preferred embodiments, the fluid power source can be a low power source, e.g., having a power of 10-100 W. Example devices have a weight of about 2 kg or less excluding the power source. It is also contemplated for devices to have a weight of 1 kg or less. The power source is preferably belt worn and adds about an additional 1.2 kg for an example $CO_2$ portable bottle, but can provide a significant operational range; as a nonlimiting example, ~40 minutes of continuous use, and longer depending upon conditions, level of assistance, and amount of use. Operating temperature preferably is below 100° F. Use can be extended easily by simply inserting a recharged gas cylinder or other changeable power source.

A preferred embodiment orthosis using a low power $CO_2$ fluid power source includes a rotary actuator that provides up to about 10 Nm of torque, though rotary actuators providing more than 10 Nm are also contemplated, such as for providing more than partial assist. A compact, lightweight lower leg and foot bed structural shell of carbon fiber or other suitable material can be custom molded to an individual user to be unobtrusive and work with normal clothing and footwear. A small battery or other suitable power source, such as but not limited to a 9V battery, 2×AA batteries, or equivalent secondary battery, provides power for the on-board controller. In an example fitting session, the controller includes software (or firmware or hardware) that can receive information about the individual and the individual's condition, and the amount of assistance in propulsive gait and in braking can be tailored by adjustment of control parameters. While an example orthosis of the invention can rely upon a uniform resistive force for braking, example controllers and actuators can also provide active braking.

The active nature of example devices of the invention provides the flexibility to assist both the plantarflexor and dorsiflexor muscle groups in approaching their functional objectives during gait. An example rotary actuator can control the velocity of the foot during initial contact to prevent foot-slap, provide torque at the end of stance for propulsion, support the foot in the neutral (or 90°) position during swing to prevent foot-drop, and allow free range of motion during the rest of the cycle. Timing and magnitude of the assistance can be determined uniquely for each user through the electronic controller and/or mechanical adjustments. For example, tuning can be accomplished using feedback from the sensors on the device, measurements from lab equipment, observation from the investigators, and/or feedback from the participant to determine a subject specific control scheme that is downloaded to the microprocessor embedded in the example on-board controller.

An example operation assists impaired gait by determining a phase in a gait cycle and providing controlled resistance or assistance. For example, at heel strike, an example orthosis can control forefoot velocity to prevent foot slap by providing eccentric dorsiflexor assistance. At the end of stance, the example device can provide modest assistive torque for propulsion and stability by providing concentric plantarflexor assistance. During swing, the example device can support the user's foot in the neutral position during swing to prevent foot drop by providing concentric dorsiflexor assistance. During other parts of the gait cycle, the example device can allow free range of motion.

Preferred embodiments will now be discussed with respect to the drawings. The drawings include schematic figures that may not be to scale, which will be fully understood by skilled artisans with reference to the accompanying description. Features may be exaggerated for purposes of illustration. From the preferred embodiments, artisans will recognize additional features and broader aspects of the invention.

FIGS. 2-5 show a portable, active ankle foot orthosis device 20 according to an embodiment of the present invention. The device 20 includes a lower leg or tibial mount component or assembly (lower leg mount) 22 and a foot bed component or assembly (foot bed) 24 pivotally coupled (e.g., attached) to one another at or proximate to an ankle position of a user wearing the device. In the example device 20, the lower leg mount 22 and the foot bed 24, which serve as structural elements of the device are pivotally coupled via a pneumatically powered rotary actuator 26 at or proximate to an ankle position; e.g., the ankle joint. A free motion ankle hinge joint connects the foot bed 24 to the leg mount 22 on the medial aspect, though this is not required for all devices. A particular, nonlimiting example pneumatic actuator 26 is a dual-vane bidirectional rotary actuator (e.g., CRB2BW40-90D-DIM00653; SMC Corp of America, Noblesville, Ind., USA).

Figure 5:
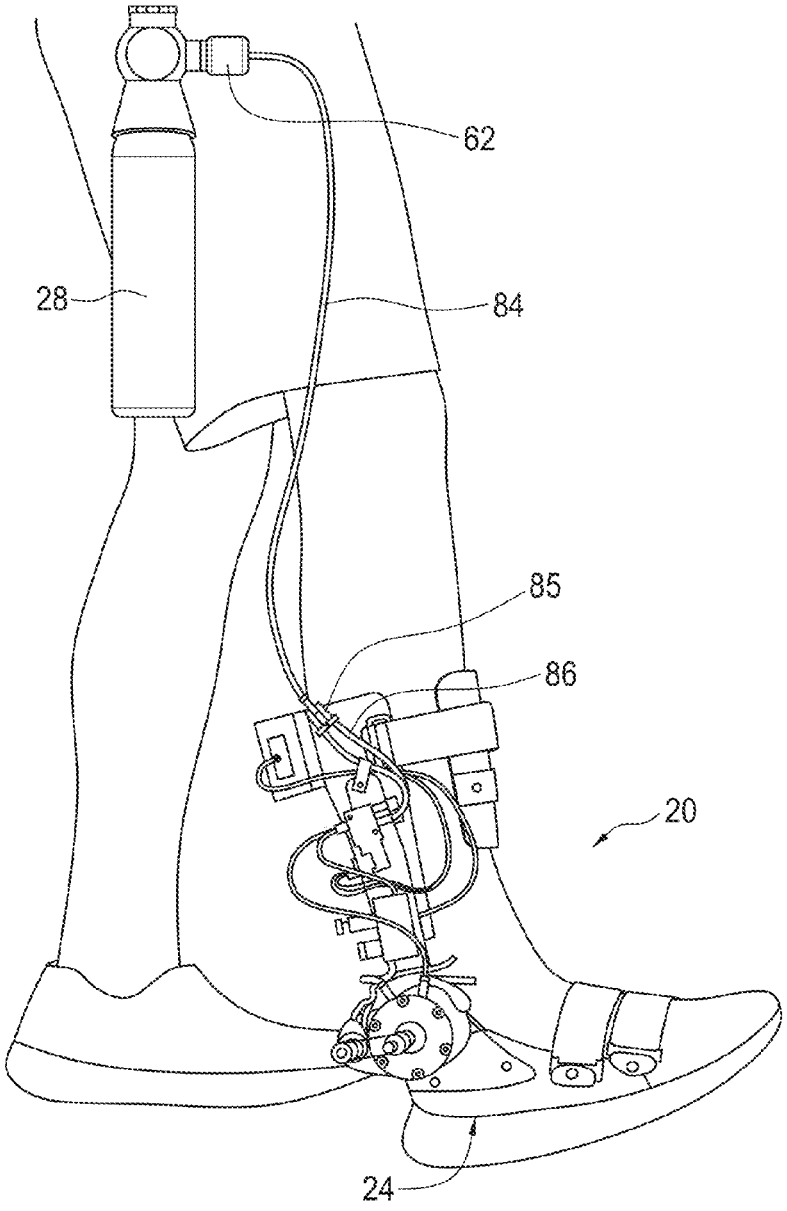
FIG. 5 shows the active ankle foot orthosis of FIGS. 2-4 worn around a leg of a user and coupled to a fluid power source.

The actuator 26 is configured to receive power from a portable fluid power source and provided controlled force and/or resistance to aid or inhibit relative motion between the lower leg mount 22 and the foot bed 24. As shown in FIG. 5, a nonlimiting example portable fluid source is a $CO_2$ (or other suitable fluid) container, e.g., bottle 28, which, for example, may be worn on a belt or elsewhere on a user. A nonlimiting example $CO_2$ container is a 255 g portable compressed liquid $CO_2$ bottle (JacPac J-6901-91; Pipeline Inc., Waterloo, Calif.) worn by the user on the waist. Providing the portable fluid power source 28 allows untethered powered assistance. An on-board controller 30, e.g., a microcontroller, integral to the device 20 (that is, coupled to and movable with the device, as opposed to being separated from or tethered to the rest of the device) accepts data input from measuring devices for determining a stage of gait. Nonlimiting examples of such measuring devices include force sensors (e.g., force sensitive resistors; a particular nonlimiting example is a 0.5" circle obtained from Interlink Electronics, Camarillo, Calif.), for instance a fore foot (or front, or toe) sensor 32 and a rear sensor 34. A rotary sensor 36, which in the example device 20 is a belt drive potentiometer, preferably is also provided to control the actuator 26 during active assistance of the user.

The lower leg mount 22 (which generally refers to any structure suitable for at least partially holding and supporting a part of a user's lower leg or shank during gait) in the example device 20 includes a cuff 40, or all or part of a sleeve, configured for accommodating and at least partially supporting a lower leg of the user. The cuff 40 should be as lightweight as possible, while providing sufficient support for the lower leg and for any components of the device 20 that are attached thereto. For example, in the device 20, the controller 30 is attached to a rear portion of the lower leg mount 22. The lower leg mount 22 preferably includes a light, fairly rigid inner frame, e.g., carbon fiber or carbon composite, light metal, or plastic, which is lined and padded for user comfort. A strap 42 fits a front plate 44 to a shin of the user (e.g., see FIG. 5) and can be tightened around the lower leg after the user places his/her foot in the foot bed 24, to secure the cuff 40 and the front plate 44 around the lower leg. The front plate 44, as with the cuff 40, can include a rigid inner frame (e.g., carbon fiber or carbon composite, light metal, or plastic) that is lined and padded. It is also contemplated that the leg mount 22 could have a small diameter (e.g., ~18 cm ID cylinder) for fitting inside a user's pants leg, though this is not required in all embodiments.

The foot bed 24 in the example device 20 (generally, any structure suitable for at least partially holding and supporting a part of a user's foot during gait), which can be configured for a right or left foot and be sized according to an individual user, includes a base 45 having an inner frame of a sturdy, lightweight material (e.g., carbon fiber or carbon composite (such as but not limited to pre-impregnated carbon composite laminate material), light metal, or plastic), which is preferably lined and/or padded. A bottom plate 46 of the foot bed 24 supports the user's foot, which can be held within the foot bed 24 by one or more straps 48. The straps 42, 48 may be any suitable strap, including but not limited to straps fastened by suitable fasteners, e.g., buckles or hook-and-loop fasteners (such as VELCRO® fasteners). A sole 49, preferably with suitable padding, is provided underneath the bottom plate 46 to provide an interface with the ground and for cushioning during walking. As a nonlimiting example, a standard shoe sole could be used. The foot bed 24 can vary in terms of, as nonlimiting examples, height of the heel relative to the metatarsal heads, angle (pitch) of a toe section, etc. It is also contemplated that the foot bed 24 could be configured to fit inside a (e.g., modified) running or walking shoe, with the sole 49 being provided by the sole of the shoe.

Figure 2:
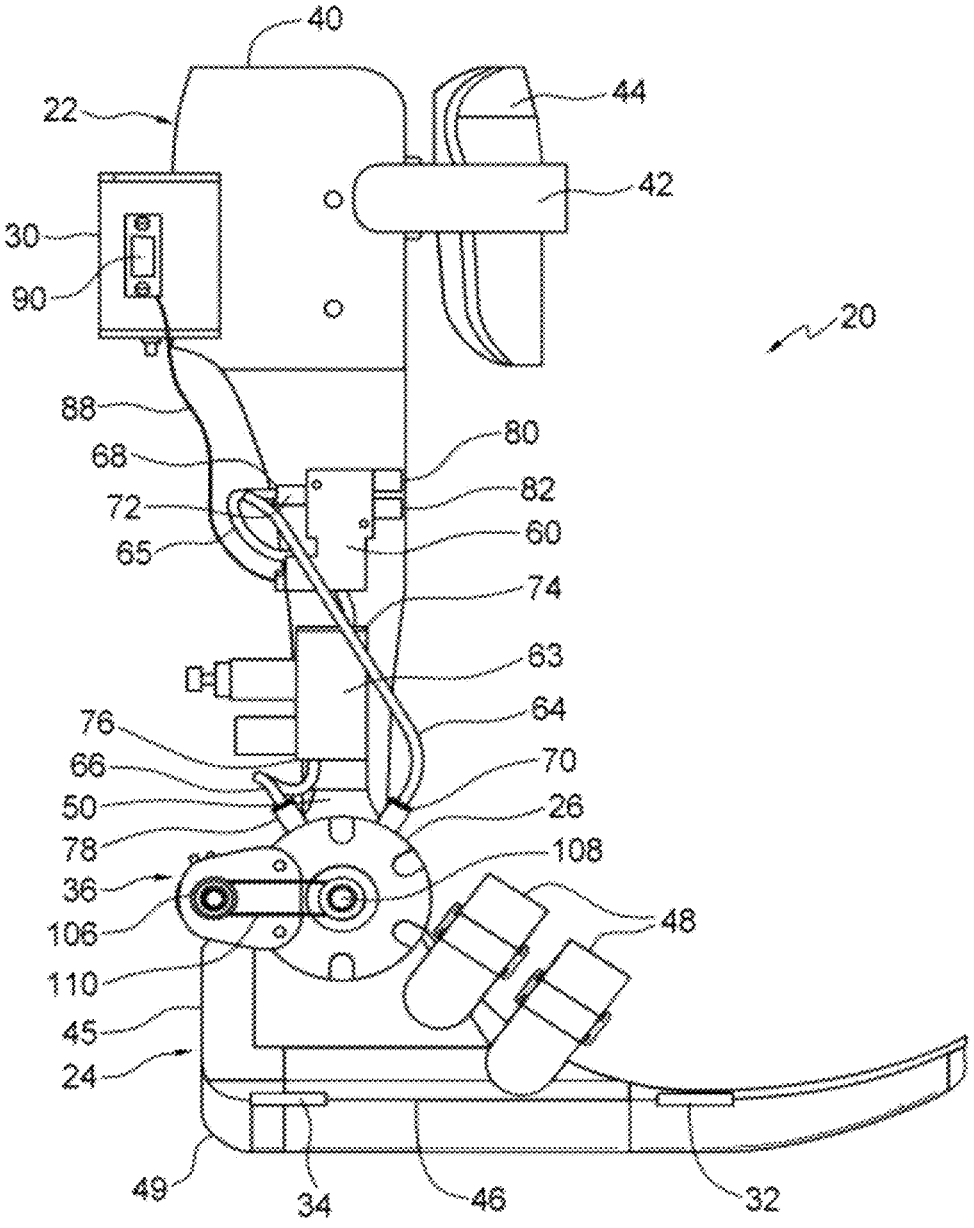
FIG. 2 is a side elevation view of an active ankle foot orthosis, according to an embodiment of the present invention.
Figure 3:
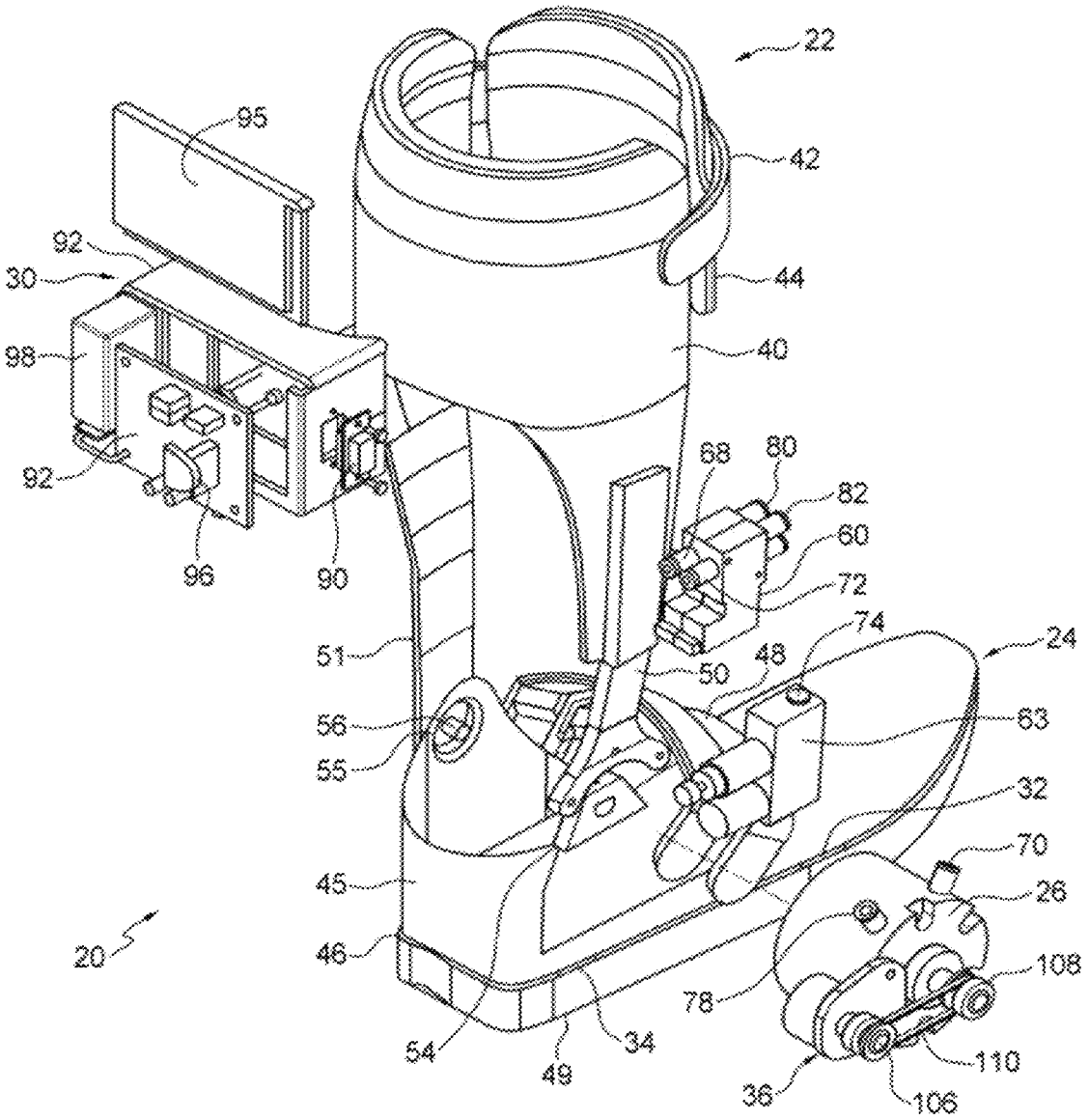
FIG. 3 is an exploded rear perspective view of the active ankle foot orthosis of FIG. 2.
Figure 4:
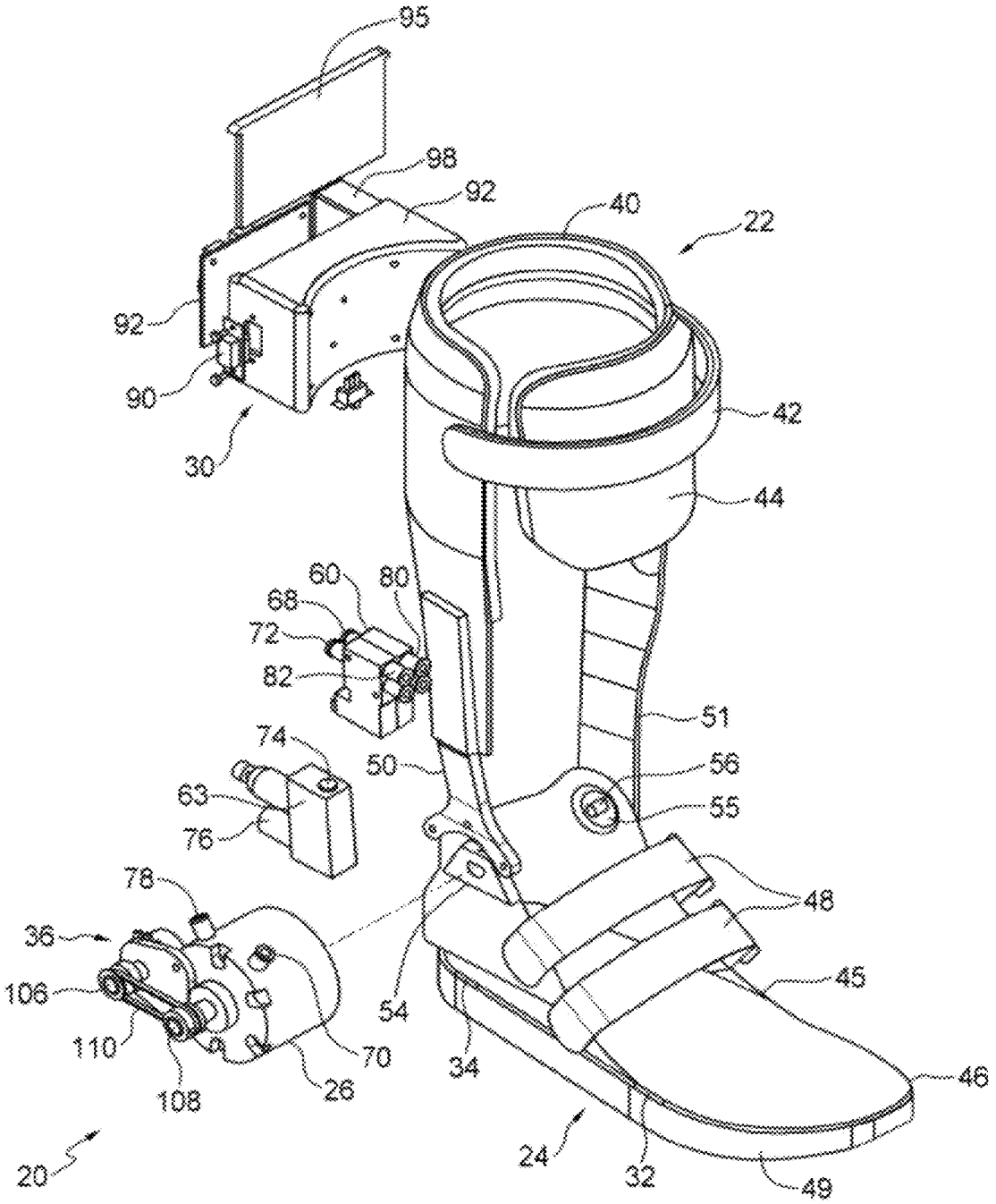
FIG. 4 is an exploded front perspective view of the active ankle foot orthosis of FIGS. 2-3.

For coupling to the actuator 26 and to the foot bed 24, the lower leg mount 22 also includes a pair of laterally opposed rigid lower members such as struts 50, 51 which preferably are made of a rigid material (e.g., a light metal). The struts 50, 51 may be integrally formed with the inner frame of the lower leg mount 22, or may be separate components rigidly coupled to the inner frame, as shown in FIGS. 2-4. One of the struts 50 couples the leg mount 22 to the actuator 26, while the other 51 preferably couples the leg mount to the foot bed 24 via the free motion ankle hinge joint. Each of the struts 50, 51 is preferably configured to couple the lower leg mount 22 to the foot bed 24 while rigidly supporting the lower leg mount such that relative movement of the lower leg mount and the foot bed (e.g., during operation of the actuator) does not alter the structure and leg support provided by the lower leg mount. Also, one or both of the struts 50, 51 can be used in particular example embodiments to support other components of the device, alone or in combination with the inner frame of the lower leg mount 22. In other embodiments, only one of the struts (e.g., strut 50) is provided, and the other strut (e.g., strut 51) and the separate free motion ankle hinge is omitted.

Similarly, the foot bed 24 includes a pair of laterally opposed rigid upper members such as extensions 54, 55 (best seen in FIGS. 2 and 4), which extend upwardly from the base 45 for rigidly coupling to the actuator 26 and to the lower leg mount 22. The extensions 54, 55 may be integrally formed with the base 45 or may be fixedly coupled to the base. One of the extensions 54 couples the foot bed 24 to the actuator 26, while the other extension 55 preferably couples the foot bed to the strut 51 on the lower leg mount 22 via a suitable pivotal attachment, such as the free motion ankle hinge joint. As with the struts 50, 51, it is also contemplated that the extension 55 can be omitted in embodiments where the lower leg mount 22 and the foot bed 24 are pivotally coupled only via the actuator 26. In an example embodiment to provide the free range joint, the strut 51 includes a rotational coupling such as a pin 56, which is inserted into an aperture of the extension 55 for allowing relative rotation of the strut and the extension. However, it will be appreciated that other rotational couplings may be used.

The example pneumatically powered rotary actuator 26 shown in FIGS. 2-4 is a rotary actuator similar to that used for conveyor systems. However, the invention is not to be limited to the particular actuator 26 shown. For example, more compact designs, lighter designs, more efficient designs, etc. can be used, as will be appreciated by those of ordinary skill in the art. In an example embodiment, fluid control for the actuator 26 is provided by directing flow of the fluid with valves 60, e.g., two solenoid valves (e.g., VOVG 5V, Festo Corp., Hauppauge, N.Y.), coupled to the controller 30. These valves allow the direction of the torque to be switchable between dorsiflexor and plantarflexor. A pair of fluid pressure regulators 62, 63 (fluid regulators) can also be provided to manage the force produced by the actuator. For example, the fluid pressure regulator 62 can be on or proximate to the fluid power source 28 (FIG. 5), such as but not limited to a pressure regulator provided on the fluid power source itself. The fluid pressure regulator 62 modulates plantarflexor torque for propulsion assistance. The additional fluid pressure regulator 63 (e.g., LRMA-QS-4; Festo Corp.; Hauppage, N.Y., USA), which can be disposed between the valves 60 and the actuator 26, can be used to modulate dorsiflexor torque for foot support during swing.

As shown in FIG. 2 particularly, the valves 60 and the additional fluid regulator 63 can be supported by the strut 50 of the lower leg mount 22, though it is also contemplated that the valves and/or fluid regulator can be supported by the frame of the lower leg mount, or by other parts of the device 20. The valves 60 and the additional fluid regulator 63 can be coupled, e.g., attached, to the strut 50 or other portions of the lower leg mount 22 or elsewhere on the device 20 by any suitable devices or methods, including but not limited to mechanical fasteners and/or adhesives. An alternative pneumatically powered rotary actuator can include electronically controlled fluid control for direct control by the on-board controller 30, and in this case separate valves and/or a fluid regulator may not be necessary. It is also contemplated that other valves, e.g., more compact and/or lighter valves, may be used in place of the valves 60 to make the overall device 20 lighter and/or more compact.

So that the valves 60 can selectively control fluid flow to the example actuator 26, fluid couplings, e.g., lines 64, 65, 66, couple the actuator and the valves. Particularly, fluid line 64 is disposed between an output 72 of one of the valves 60 and an input 70 of the actuator 26, directly coupling the valve and the actuator. Additionally, fluid line 65 is disposed between an output 68 of another of the valves 60 and an input 74 of the pressure regulator 63, and fluid line 66 is disposed between an output 76 of the pressure regulator and another input 78 of the actuator, providing an indirect fluid coupling between the valves 60 and the actuator 26. The fluid lines 64, 65, 66 may be any suitable opening sealed with fluid tubing, and the inputs 70, 74, 78 and the outputs 68, 72, 76 may be any suitable fluid caps or seals with passages for the fluid lines.

It is preferred that the fluid lines 64, 65, 66, inputs 70, 74, 78, and the outputs 68, 72, 76 are of a lightweight material, such as lightweight tubing material, to minimize weight of the overall device 20. Those in the art will appreciate that various individual or combined components may be used for the fluid lines 64, 65, 66, inputs 70, 74, 78 and outputs 68, 72, 76. A nonlimiting example weight for the device 20, without the $CO_2$ or other fluid container 28, is 1.9 kg.

Inputs 80, 82 of the valves 60 (suitably sealed and/or capped) are in turn coupled to an output of the fluid power source, e.g., the $CO_2$ container 28. In a nonlimiting example embodiment, the output of the $CO_2$ container 28 is input to the first fluid regulator 62 and then output via line 84 (FIG.

5) to a splitter 85 having outputs coupled to suitable fluid lines 86 connecting the outputs to the inputs 80, 82 of the valves 60. Fluid lines may be similar to the fluid lines 64, 65, 66 used for other connections, or may be of a different type. Artisans will appreciate that various fluid lines, splitters, seals, caps, etc. may be used. The example $CO_2$ container is preferably belt worn and is relatively light (e.g., about 1.2 kg for an example $CO_2$ portable bottle), but can provide an operational range suitable for untethered operation of the device 20 (e.g., about 40 min. continuous use, longer depending upon conditions, level of assistance, and amount of use). In a nonlimiting example, plantarflexor regulated torque is ~10 Nm at 90 psi, and dorsiflexor regulated torque is ~3 Nm at 30 psi. Use can be extended easily by inserting a recharged gas cylinder or other power source.

The example solenoid valves 60 are configured to be selectively controlled by the on-board controller 30. In an example embodiment, the direction of the torque can be switched between dorsiflexor and plantarflexor by controlling the two solenoid valves 60. Suitable leads 88 electrically couple an input/output connection 90 of the on-board controller 30 to the valves 60 for operating the solenoids.

As best seen in FIG. 3, the example on-board controller 30 includes an outer housing 92 containing a circuit board 94. The housing 92 can include a curved outer surface for coupling to the lower leg mount 22 while reducing total device volume. Attachment of the housing 92 to the device, e.g., to the lower leg mount 22, can be accomplished using any suitable method or device, including mechanical devices and/or adhesives. A cover 95, which may be vented, encloses the housing 92.

The circuit board 94 includes a microprocessor 96 (with suitable memory), power source (as nonlimiting examples, a 9V battery, 2×AA batteries, etc.) 98, an input (of the input/output connection 90) for electrically coupling to the sensors 32, 34, 36, and an output for coupling to the valves 60. A nonlimiting example controller is eZ430-F2013 microcontroller, Texas Instruments, Dallas, Tex. Example controllers 30, including the microprocessor 96, the circuit board 94, etc., can be commercially obtained or custom made to reduce size, weight, power requirements, etc. As a nonlimiting example, a customized chip may be provided in place of one or more components. Coupling between the on-board controller 30 and the sensors 32, 34, 36 can be wired or wireless. The microcontroller preferably is configured, e.g., programmed, via suitable hardware, firmware, or software, to control the valves 60 and thus the actuator 26 based on input from one or more of the sensors 32, 34, 36, according to methods of the present invention.

The sensors 32, 34, 36 are disposed in or on the device 20 to allow feedback for input to the controller 30. In an example embodiment the rear sensor 34 is disposed in or on the base 45, foot plate 46, sole 49, or elsewhere in or on the foot bed 24 to receive pressure information at or near the heel of the foot bed. Similarly, the fore foot sensor 32 is disposed in or on the base 45, foot plate 46, sole 49, or elsewhere, and preferably is placed under the metatarsal head of the foot bed, to receive pressure information near the front of the foot bed, e.g., at or near the toe of the user's foot. A nonlimiting example placement for the sensors 32, 34 is between the foot plate 46 and the sole 49. As nonlimiting examples, the sensors 32, 34 may be force-sensitive resistors. The example angle (e.g., rotary) sensor, in the example embodiment shown in FIGS. 2-4, is supported by the actuator 26, though this is not necessary in all embodiments. In the example device 20, the angle sensor is provided by a potentiometer 106 (e.g., 53 Series; Honeywell, Golden Valley) coupled to a shaft 108 on the actuator 26 by a belt 110 for sensing a change in angle between the foot bed 24 and the lower leg mount 22. Those in the art will appreciate that alternative ways of sensing the angle between the foot bed 24 and the lower leg mount 22 are possible.

Figure 6:
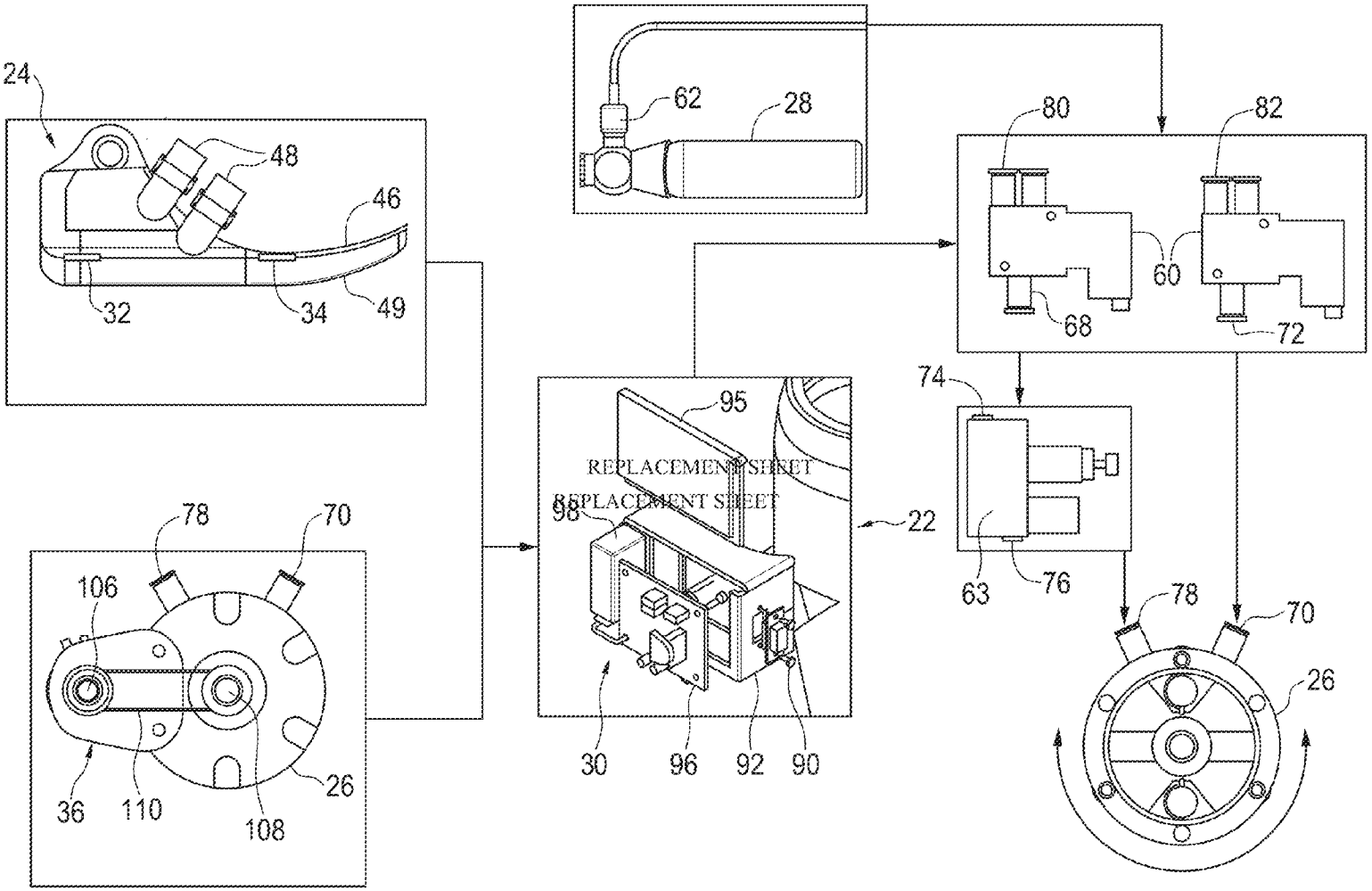
FIG. 6 shows interactivity of various components of the active ankle foot orthosis during operation, according to a method of the present invention.

FIG. 6 shows interaction among components of the device 20 during an example operation. The rear sensor 34 and fore foot sensor 32 sense pressure on the heel and front foot (e.g., near the toe) of the user during gait, and the angle sensor 36 senses the angle between the lower leg mount 22 and the foot bed 24. The force sensor readings 32, 34, and in example embodiments the angle sensor 36 readings as well, are sent to the on-board controller 30 via the input 90 and more particularly to the microcontroller 96, which processes the sensor inputs.

The controller 30 then outputs (e.g., via input/output connection 90) control signals for selectively operating the solenoid valves. The valves are supplied with fluid pressure by the coupling with the fluid power source. One of the valves 72, selectively controlled by the controller 30, outputs pressure directly to the pneumatically powered rotary actuator 26 via the input 70. The other valve 80, also selectively controlled by the controller, outputs fluid to the second pressure regulator 63, which in turn provides pressure to the other input 78 of the actuator 26. The pneumatic power provided by the selectively controlled valves 80, 82 provides controlled torque and/or resistance for the pneumatically powered actuator 26 to aid or inhibit relative rotation of the lower leg mount 22 and the foot bed 24.

Generally, to control the device in a first example method, the controller 30 determines the occurrence of particular phases or events within the user's gait cycle, such as by using the readings of the heel sensor 34 and fore foot sensor 32, and accordingly provides assistance or resistance by switching control of the valves to change direction of torque between dorsiflexor and plantarflexor, provide an appropriate amount of dorsiflexor and/or plantarflexor torque, or allow free range of motion (or substantially free range of motion with mild resistance). An example control scheme is illustrated in FIGS. 7-11. Other control schemes may be suitable for different users and for different conditions that merit use of the orthosis.

Figure 7:
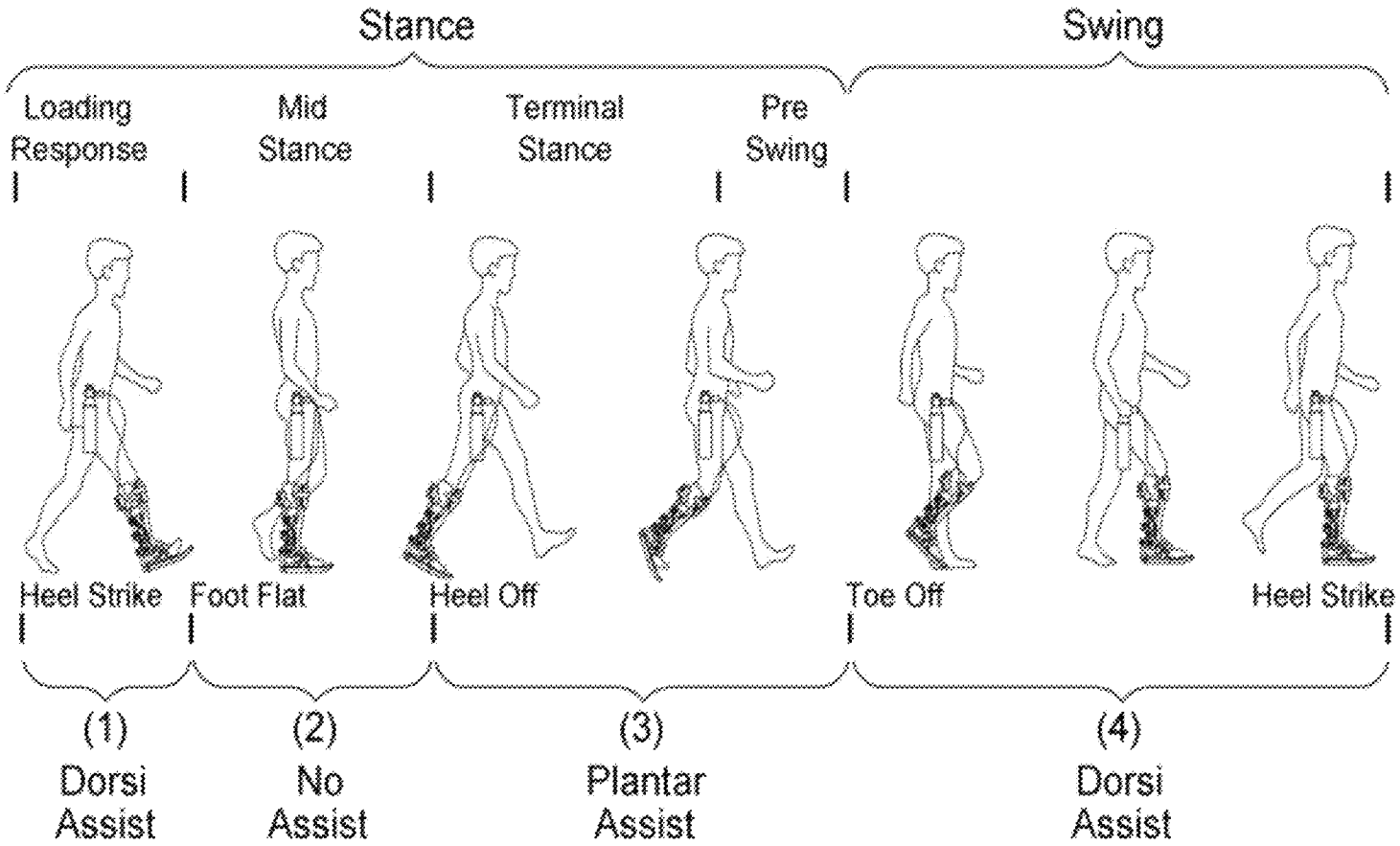
FIG. 7 shows phases during a normal gait cycle.

FIG. 7 illustrates control states addressed by the example controller 30 and the actuator 26 during normal gait. Generally, to assist different functional aspects of gait, inputs from the sensors 32, 34 are processed to provide event boundaries that divide the gait cycle into states during which a particular control action is applied. Four states are determined in an example control method: initial contact or loading response, mid-stance, terminal stance/pre-swing, and swing. These example states are defined as occurring between ("between" can be inclusive or exclusive) four events: heel strike, foot flat, heel off, and toe off. Events can be detected, for example, when sensor magnitudes exceed or drop below tuned user-specific thresholds for the sensors 32, 34.

Initial contact (loading response) is defined from heel strike until the foot is flat on the ground. During this state the orthosis 20 provides dorsiflexor assistance to control the velocity of the foot as it travels from heel strike to foot flat, increasing joint impedance to avoid foot slap. Mid-stance lasts from foot flat until the heel comes off the ground, and during this state the orthosis 20 allows (for example) free range of motion at the ankle joint. Terminal stance begins when the heel has come off the ground, and ends when the foot is no longer in contact with the floor, after toe off. Plantarflexor torque (preferably modest torque) is applied during this state to provide assistance at the end of stance for propulsion, as well as stability. Swing, or limb advancement, begins at toe-off and lasts until the heel again makes contact with the ground. Dorsiflexor torque is applied by the orthosis 20 to support the foot in the neutral (or 90 deg) position to maintain clearance during swing and prevent foot drop. Preferably, the sensors 32, 34, 36 and programming in the controller can also detect an altered gait, for instance, corresponding to stair climbing or running, by providing suitable feedback.

In example embodiments, the timing of the four states described above and the magnitude of the torque assistance provided can be determined uniquely for each individual and for each condition to be addressed. This can be accomplished in example embodiments using feedback from sensors of the device, e.g., the rear (e.g., heel) sensor 34, the fore foot sensor 32, and in some example embodiments the angle sensor 36, as well as (for instance) measurements from lab equipment, observation from the investigators, and feedback from the participant. Once these values have been determined, a subject specific control scheme can be created and installed, e.g., downloaded, to the microcontroller and memory in the on-board controller 30.

Figure 8:
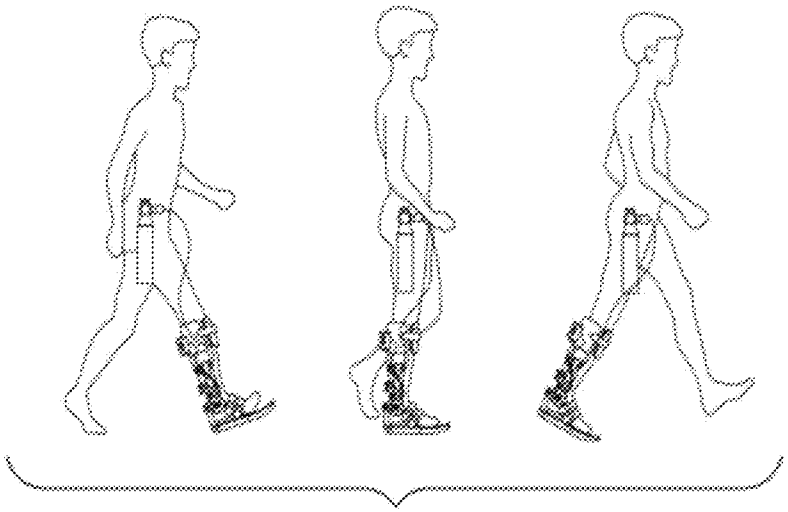
FIG. 8 shows an example method for determining weight acceptance and single limb support and for controlling the active ankle foot orthosis.

FIG. 8 illustrates and outlines an example control state of the orthosis 20 during weight acceptance and limb support (the initial contact and mid-stance stages) and provides preferred basic control functions accomplished with the orthosis. The initial contact and mid-stance stages can be defined using event boundaries that occur between heel-strike and heel-off. Thus, the initial contact stage can be defined beginning when the rear sensor 34 reading is above a threshold and ending when both the heel sensor and the fore foot sensor 32 readings are above a threshold (i.e., foot flat). Mid-stance can be defined beginning at foot flat and ending when the rear sensor 34 reading is below the threshold but the fore foot sensor 32 reading is above a threshold (i.e., heel off). The threshold for each event and/or stage in the gait cycle can be set for individual users, devices, etc. During weight acceptance and limb support, there is a functional need for controlled deceleration of the foot (e.g., during initial contact), stability and support during stance, and a free range of motion at the joint (e.g., during mid-stance). This can be accomplished in example embodiments using the device to produce a modest dorsiflexor resist to control the motion of the foot to foot flat.

Figure 9:
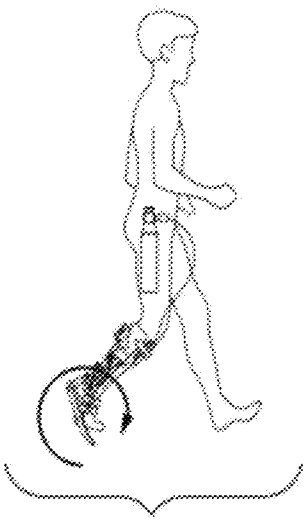
FIG. 9 shows an example method for determining push-off and for controlling the active ankle foot orthosis.

FIG. 9 illustrates and outlines an example control state of the orthosis 20 during the push off stage. This stage, which extends from heel-off to toe-off, can be defined as beginning at a time when the fore foot sensor 32 reading is above a threshold but the rear sensor 34 reading is not (heel-off), and ending when neither the fore foot sensor reading nor the rear sensor reading is above a threshold (toe-off). At this stage, there is a need for plantarflexor torque assist for propulsion and acceleration of the leg into swing. This can be accomplished by plantarflexor torque assist.

Figure 10:
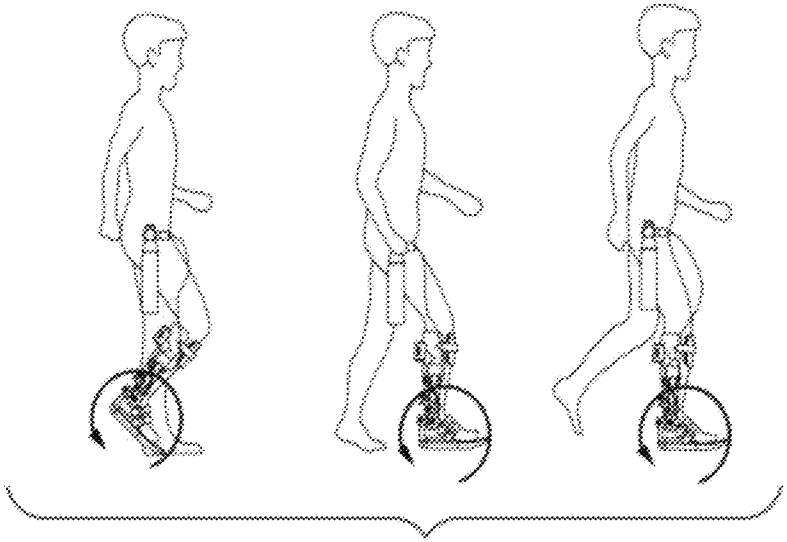
FIG. 10 shows an example method for determining limb advancement and for controlling the active ankle foot orthosis.

FIG. 10 illustrates and outlines an example control state of the orthosis 20 during swing. Swing extends from a time beginning at toe-off and ending with heel-strike. Thus, the beginning of swing can be determined to occur when both the fore foot 32 and the rear sensor 34 readings are below a threshold. During swing, there is a functional need for dorsiflexor torque to provide toe clearance. This can be accomplished using dorsiflexor torque assist, which in example embodiments can be tuned for the individual user.

Figure 11:
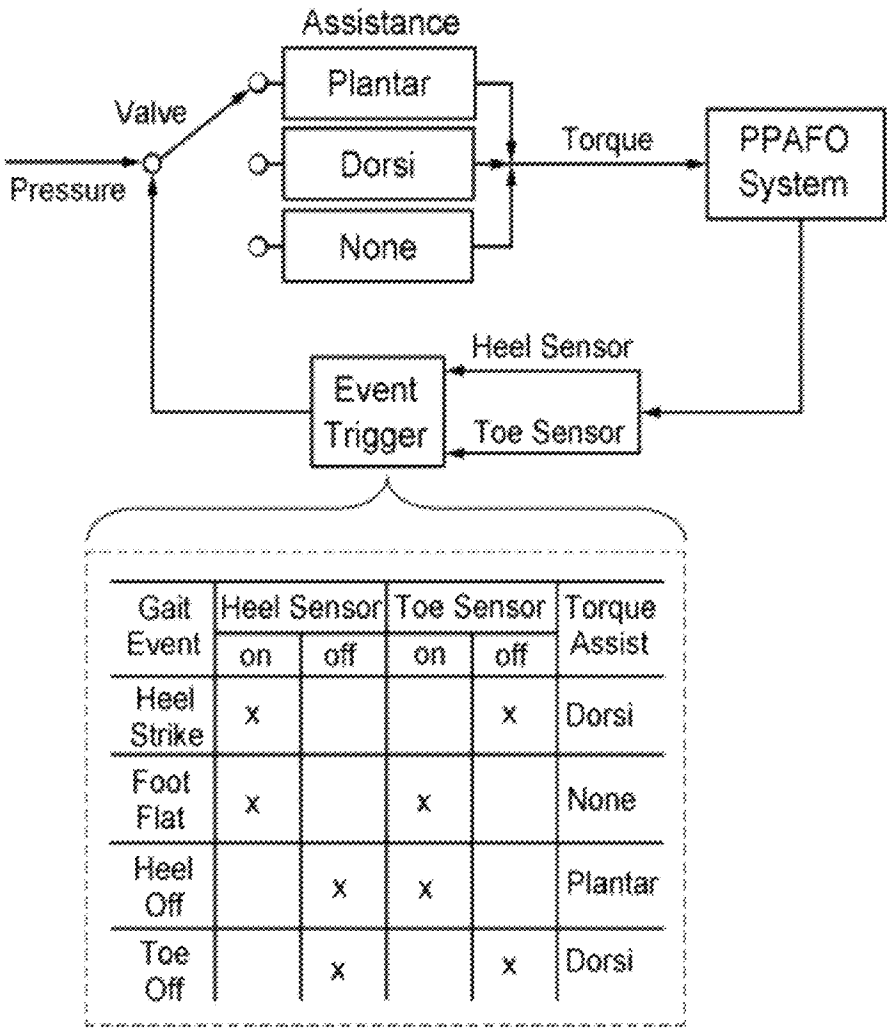
FIG. 11 shows an example control system and method for the example orthosis.

FIG. 11 shows an example look-up table and control method for determining the type of torque assist needed during various gait events, using the example event boundaries of heel strike, foot flat, heel off, and toe off. FIG. 11 also shows an example control scheme using this look-up table. In this example control scheme, which can be binary (i.e., dorsiflexor torque assistance or plantarflexor torque assistance is provided entirely or not provided) but need not be in all embodiments, the heel sensor 34 and the front sensor 32 readings are compared to predetermined thresholds, and the results are fed to the look-up table (e.g., "on" indicates a reading above threshold, and "off" indicates a reading below threshold). The controller 30 accordingly can determine the event that has triggered, and it controls the valves 60 in combination with the pressure regulators 62, 63 and fluid power source 28 to provide plantarflexor torque assistance, dorsiflexor torque assistance, or neither (e.g., during mid-stance). Note that determining the stage of gait can be accomplished by the controller 30 selecting the appropriate control or control scheme for the stage of gait based on the sensor 32, 34 reading, as shown in FIG. 11. Also, in the example algorithm shown in FIG. 11, the angle sensor 36 reading need not be used to determine a particular gait event. In other possible algorithms, the angle sensor 36 reading can be used.

A tuning scheme preferably is provided to determining the timing and magnitude of the device 20 assistance for each user. For example, pressure sensor thresholds can be adjusted for each user to determine event boundaries during the gait cycle. Adjusting sensor thresholds modifies the event boundaries that are determined. In example embodiments, redundant triggers are avoided by maintaining a threshold large enough to exceed the noise level of the unloaded sensors 32, 34. Robustness of the determined thresholds may vary, as a nonlimiting example, based on the user or the intended manner of use of the device 20. Once the sensor thresholds are determined, these can be downloaded to the controller 30.

Figure 12:
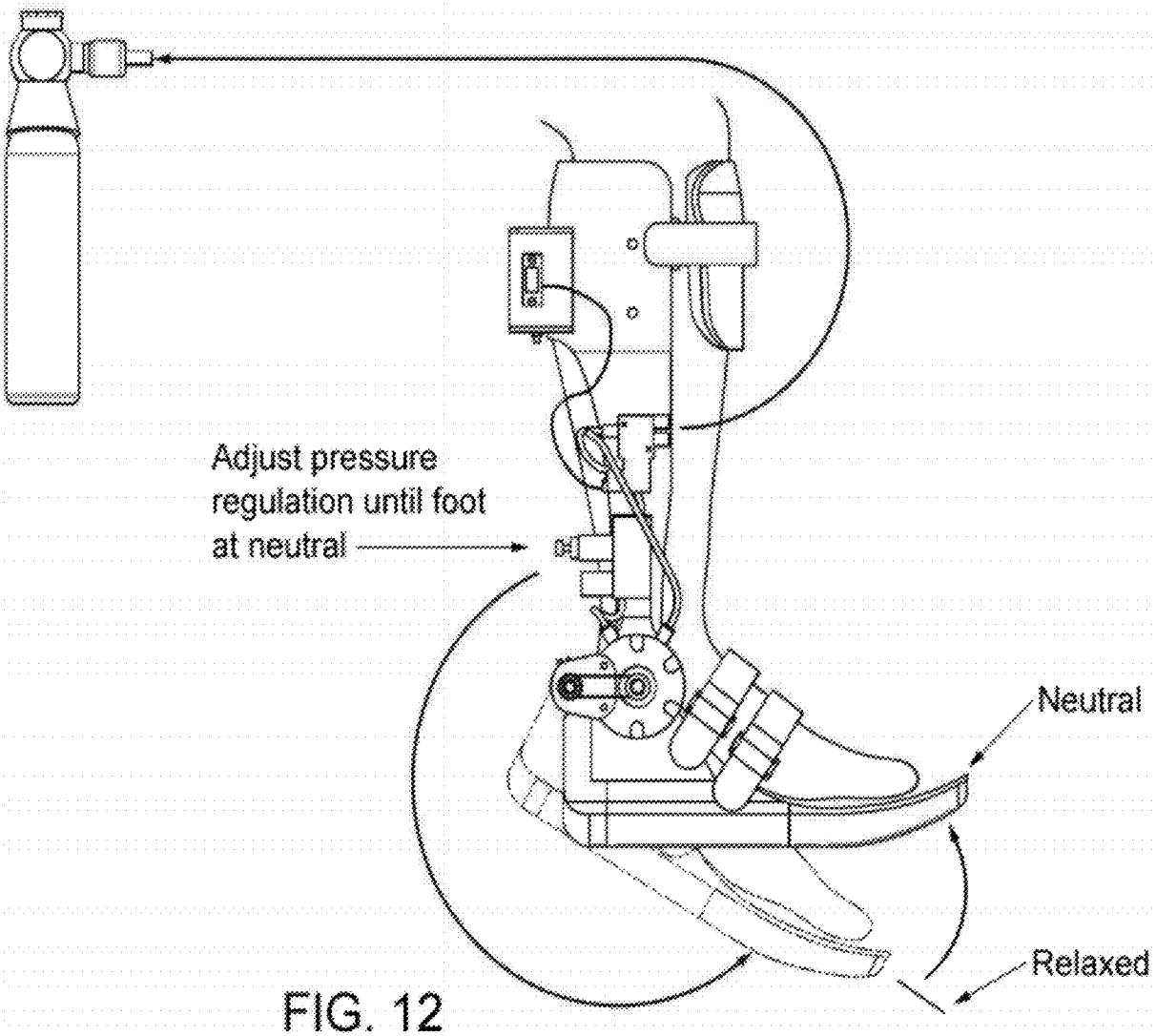
FIG. 12 shows an example method for tuning dorsiflexor assist.

FIG. 12 illustrates the first step of a heuristic tuning strategy for the example orthosis 20, which in the example shown tunes dorsiflexor assist. A user's foot is inserted into the foot bed and is in a relaxed position. This relaxed position moves the foot bed to a position at an obtuse angle with respect to the lower leg mount. To tune the dorsiflexor assist for an individual user in an example embodiment, the pressure regulation is adjusted until the foot moves to a neutral position, at about 90° with respect to the lower leg mount. In some example embodiments, during tuning a ratio and/or coefficient relating pressure and torque is established to control the actuator. The relationship may be linear or substantially linear over the operating range of the actuator, or may be a nonlinear relationship.

Figure 13:
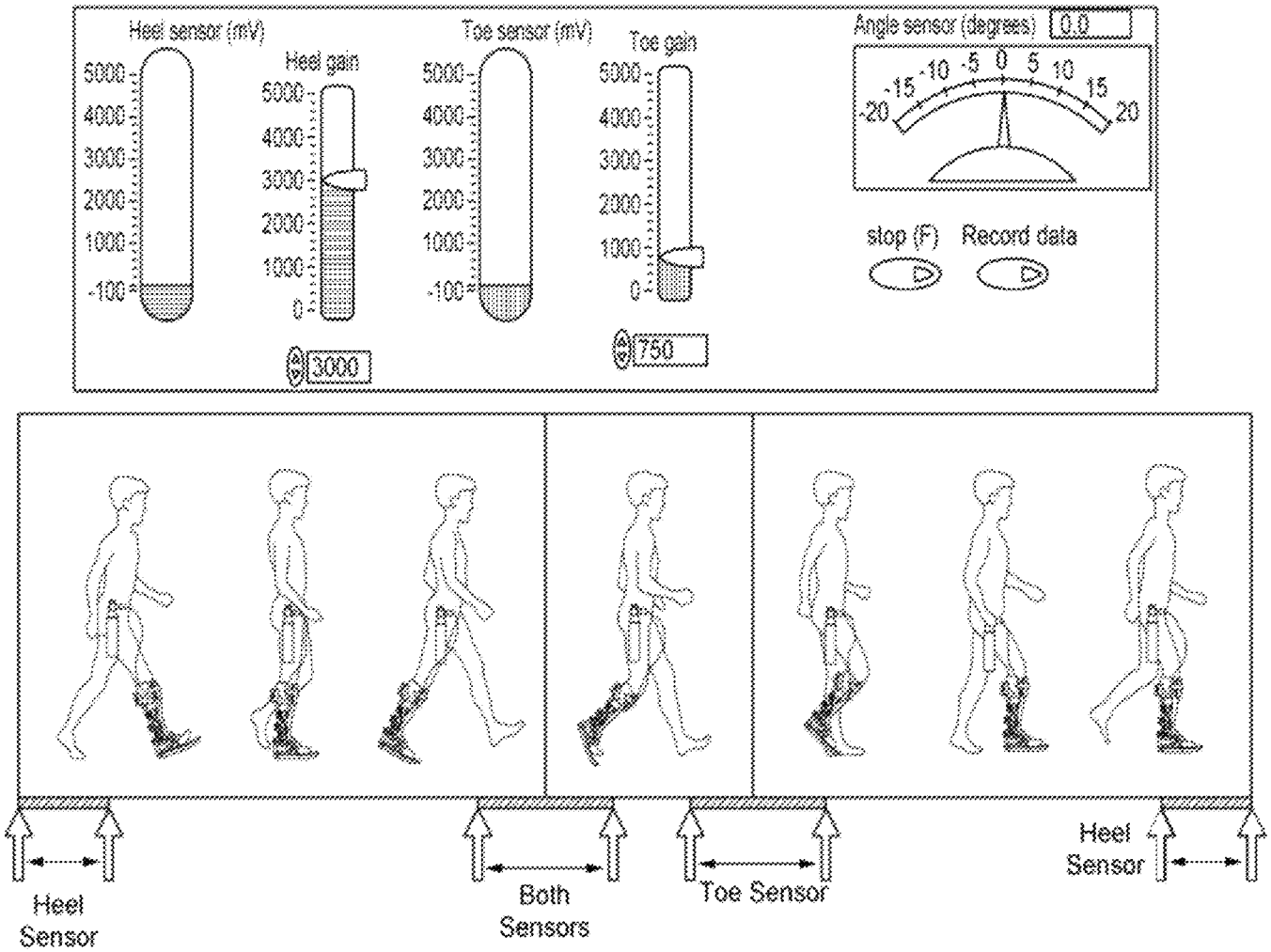
FIG. 13 shows an example method for tuning operational timing.

FIG. 13 illustrates a second step of a heuristic tuning strategy for the example orthosis 20, which tunes the timing for determining gait events and stages. The tuning may take place, as nonlimiting examples, in a lab or clinic. The orthosis 20 is fitted to a user, and the user walks wearing the device. Feedback from the heel sensor 34, front (e.g., toe) sensor 32, and angle sensor 36 is recorded and analyzed. For example, prior to the beginning of the initial contact stage, the heel sensor readings are analyzed to determine the change in the heel sensor reading between a point when the user's heel is above the ground, and when the heel contacts the ground. For the beginning of the push-off stage, readings for both the heel sensor and the toe sensor are analyzed to determine the change in the heel sensor reading to heel-off and the change in the toe sensor reading as the toe is used for the beginning of push-off. The change in the toe sensor reading after push-off is analyzed to determine the change until toe-off and the beginning of the swing stage.

In some example devices and methods, dorsiflexor and plantarflexor torque are controlled in a binary manner; i.e., either the torque is provided or not. In other example embodiments, dorsiflexor and/or plantarflexor torque can be provided in various intermediate levels. Providing intermediate levels of assistance or resistance allows, among other things, more precise torque assistance, robustness to changing walking conditions, and improved power efficiency and duration.

In an example device according to another embodiment of the invention, the solenoid valves 60 are replaced with one or more high speed proportional solenoid valves (not shown) (one nonlimiting example is LS-V05s; Enfield Technologies, Trumbull, Conn., USA) to allow varying torque assistance. Further, to provide additional robustness and improve pneumatic power efficiency, feedback control, in the form of proportional-integral-derivative (PID) controllers, can be provided.

Figure 14:
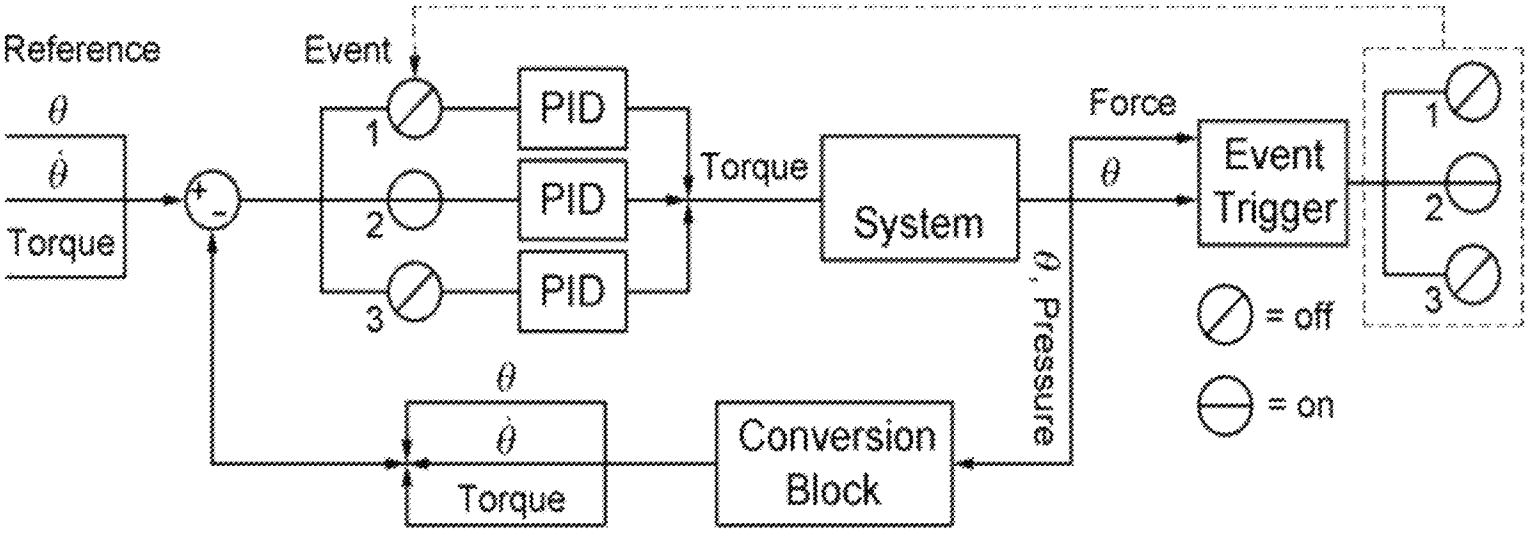
FIG. 14 shows a control system and method according to another embodiment of the invention.
Figure 15:
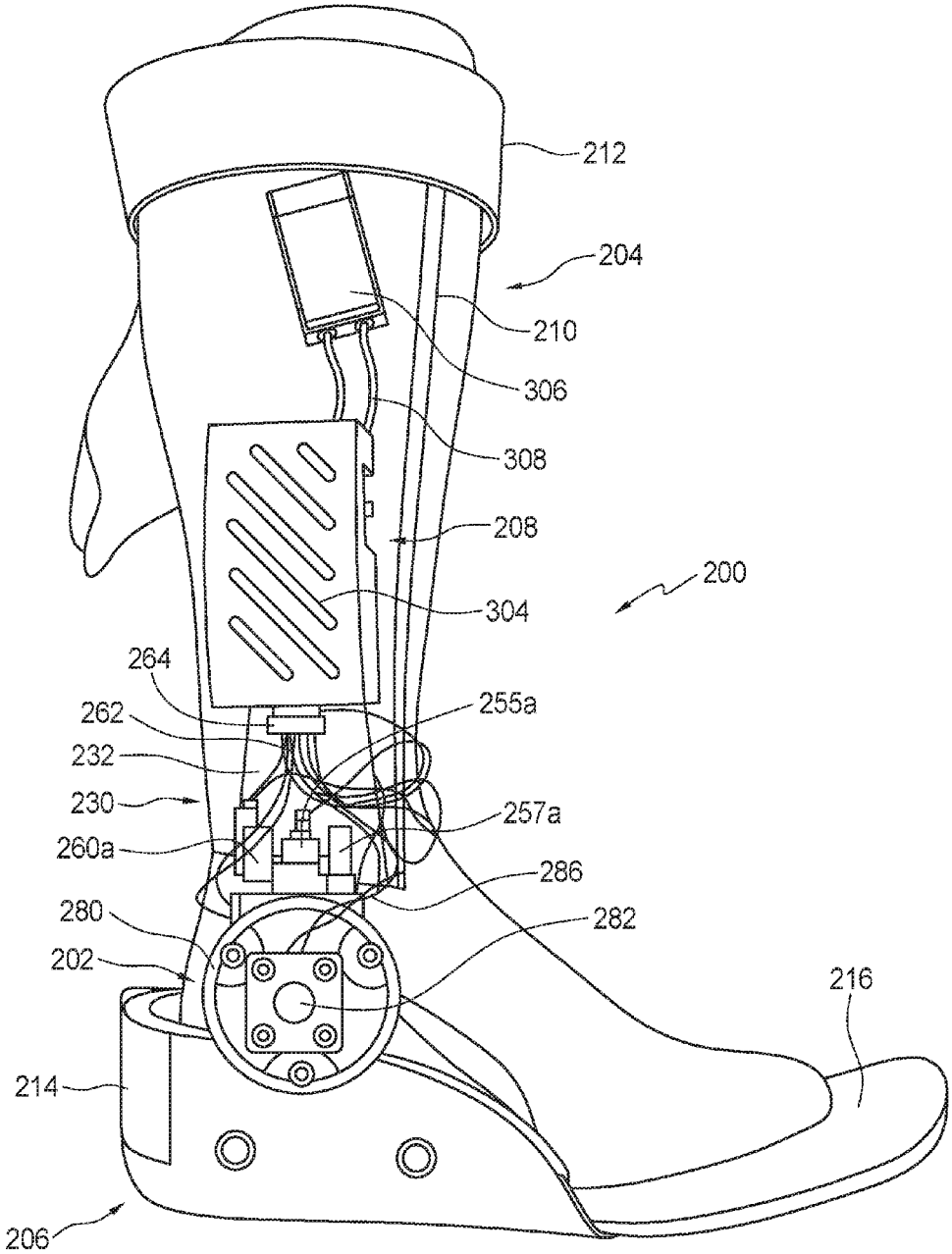
FIG. 15 is a side view of a portable powered ankle foot orthosis device according to another embodiment of the present invention.
Figure 16:
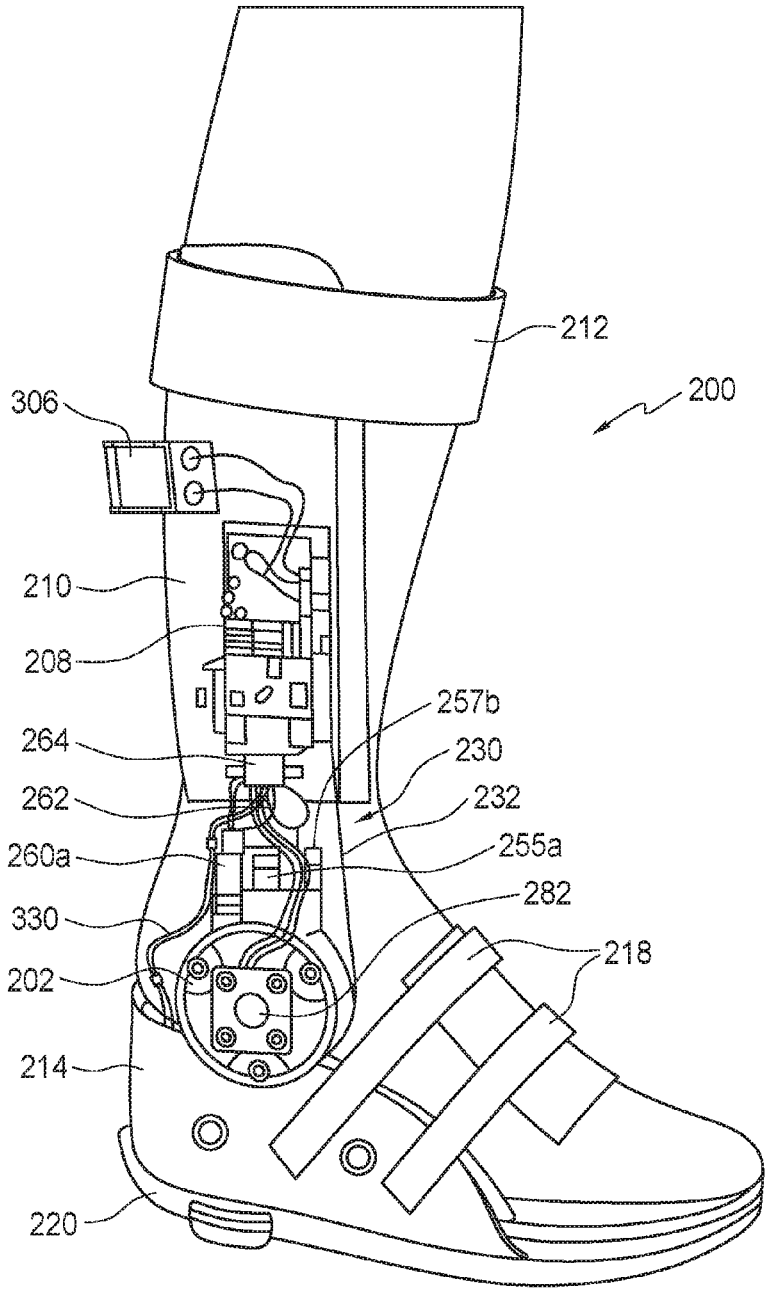
FIG. 16 is a perspective view of the orthosis device of FIG. 15, with a cover for a controller removed for illustration.

As shown in the example control system of FIG. 14, simple PID controllers can be used to accomplish various functional tasks for assisting gait. The force sensor, and in some embodiments also the angle sensor, readings are used to determine an event trigger, which in turn determines which of various tasks are to be performed and thus to open the corresponding valve configuration. The force sensor and angle sensor readings are also converted to an ankle joint angular position, angular velocity, and/or torque, which are compared to an appropriate reference. The result is input to an appropriate PID controller. The PID controller outputs a control torque, which is implemented by the rotary actuator to accomplish the selected task. Example PID controllers have the form, $$C = k_p + k_i \frac{1}{s} + k_d s,$$

where $k_p$ is the proportional gain, $k_i$ is the integral gain and $k_d$ is the derivative gain. These gains can be determined through heuristic tuning for each of the functional tasks. For example, task 1 can be to track a target velocity reference to control the motion of the foot during loading response, task 2 can be to track a reference force profile during stance for propulsion and stability, and task 3 can be to track an ankle angle reference during swing to control the motion of the foot. In the example shown in FIG. 14, task 2 is selected.

Example devices provide untethered active ankle foot orthoses that are light weight and small size. A preferred embodiment ankle foot orthosis controls and assists ankle motion using plantarflexor and dorsiflexor torque at the ankle joint, employing pneumatically-powered actuators to provide active ankle torque assistance during gait. Pneumatic power provides high force/weight and force/volume for example actuators, the ability to actuate a joint without a transmission, and the ability to transport pressurized fluid to the actuator through (for example) flexible hoses that can be placed where a shaft from a traditional motor would not reach, among other benefits.

The embedded controller 30 controls the actuation of the foot, and example devices provide the flexibility to modulate the direction (dorsal or plantar), timing, and magnitude of the assistance provided to the user. Advantageously, example devices are flexible enough to accommodate both plantar and dorsiflexor weakness and provide an excellent assistive technology for the compensation of muscle weakness.

Those of ordinary skill in the art will appreciate that various modifications, modifications, substitutions, and alternatives are possible. For example, instead of the pneumatic actuator 26 shown, an orthosis device according to another embodiment of the invention can include a more compact rotary actuator having integrated conduits and valves, for reducing the overall size of the device and/or increasing device efficiency. Additionally, the controller can be an integrated controller, with a suitable power supply and input/outputs. This controller is preferably sufficiently small as to be disposed with the rotary actuator on a portion of a support structure such as a strut to provide a modular subassembly. The controller in such embodiments can be configured to operate according to any of the example methods described herein, or according to other methods. An electronic connection between an integrated controller and the fluid power valves can be provided in particular embodiments. Additionally, an integrated sensor such as a non-contact rotary encoder (e.g., mounted to the actuator) could be provided in place of the belt potentiometer in the device 20. In addition to control electronics, example controllers can include, as nonlimiting examples, signal processing electronics, data logging capabilities, wireless communication for remote program changes and monitoring, etc.

For example, FIGS. 15-23 show a pneumatically powered orthosis device 200 according to another embodiment of the invention. Similar to the orthosis device 20 described above, the orthosis device 200 provides an untethered, powered ankle-foot-orthosis (AFO) design that controls and assists ankle motion using plantarflexor and dorsiflexor torque at the ankle joint. This example device includes a pneumatic rotary actuator 202 to provide active ankle torque assistance during gait. The example orthosis device 200 is self-contained, and preferably uses a portable pneumatic power source (not shown) such as but not limited to the fluid power source 28 used for the device 20. Alternatively, the orthosis device 200 can include a miniature homogeneous charge compression ignition (HCCI) air compressor power supply, passive noise control, and/or human/machine interfacing.

The orthosis device 200 includes a lower leg or tibial mount component or assembly (lower leg mount) 204 pivotally coupled (e.g., attached) via the rotary actuator 202 to a foot bed component or assembly (foot bed) 206 for relative rotating motion. As with the device 20, the rotary actuator 202 is disposed at or proximate to an ankle position of a user, e.g., at or near the user's ankle joint. To reduce size and weight of the orthosis device 200, the free motion ankle joint in the device 20 laterally opposing the rotary actuator 202 is preferably omitted, though in other embodiments, a free motion ankle joint can be provided. The rotary actuator is controlled via an on-board controller, e.g., a microcontroller 208, disposed on and integrated with the lower leg mount 204.

Figure 17:
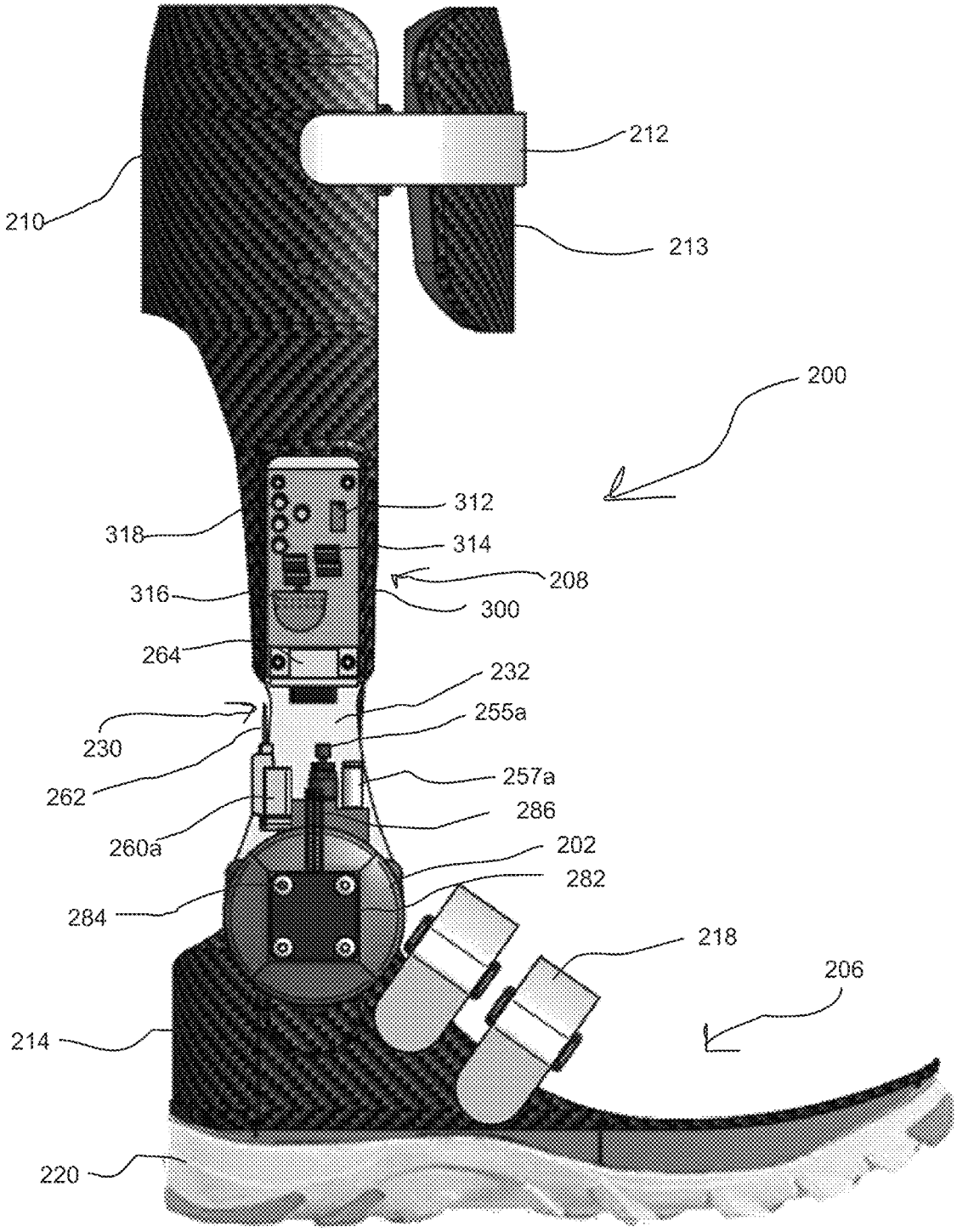
FIG. 17 is a side view of components of the orthosis device of FIGS. 15-16, with the cover for the controller removed, and the battery omitted.

As with the lower leg mount 22, the lower leg mount 204 includes a cuff 210, or all or part of a sleeve, for accommodating and at least partially supporting a lower leg of the user. The frame of the cuff 210 preferably is as lightweight as possible, while providing sufficient support for the lower leg, and in an example embodiment is composed of a carbon-fiber composite shell, though various other materials can be used (e.g., light metal or plastic). The shell can be integrated with noise and vibration abatement. A strap or straps 212, e.g., VELCRO® straps or other suitable straps, can be provided for holding the lower leg mount 204 around the user's lower leg. A front plate 213, as shown in FIG. 17, can also be provided for supporting the front of the user's lower leg, though this is not required in all embodiments. Suitable padding may be provided between the cuff 210 frame and the user's leg.

The foot bed 206 can be configured for a right or left foot and includes a frame 214 of a sturdy, lightweight material such as carbon-fiber composite, light metal, or plastic. Padding 216 can be provided to line the foot bed 206. One or more straps 218, e.g. VELCRO® straps or other suitable straps, preferably are provided for holding the user's foot within the foot bed 206. A sole 220 (FIGS. 16-17), which can be similar to the sole 49, disposed underneath the foot bed 206 provides cushioning for walking. As with the orthosis device 20, it is contemplated that the foot bed 206 can be configured to fit inside a running or walking shoe, e.g., with the sole 220 being provided by the sole of the shoe.

To reduce overall size and weight of the orthosis device 200, both the actuator 202 and the controller 208 are integrated into a subassembly 230 incorporated in a support structure for the orthosis device 200. The example subassembly 230 includes a support structure embodied in a superior-lateral support strut (strut) 232 composed of a rigid and preferably lightweight material (e.g., a light metal). This strut 232 is preferably pivotally coupled to a rigid upper member such as extension 233, best viewed in FIG. 19, which is mounted to the foot bed 206. The strut 232 in the example device 200 is fixedly coupled to the outer (lateral) side of the lower leg mount 204, e.g., mounted to the shell of the cuff 210. The actuator 202 and the controller 208 are preferably both disposed on a surface (e.g., a front surface) of the strut 232.

The actuator 202 includes a back plate 234 (best viewed in FIG. 19) that preferably is provided by a portion of the front surface of the strut 232. In the description of the orthosis device 200 with respect to FIGS. 15-23, "front" is oriented in the direction out of the drawing in FIG. 17, and "back" is oriented in the direction into the drawing in FIG. 17. Alternatively, the back plate 234 can be provided by a separate, thin plate suitably mounted to the strut 232 at a similar location, though this will increase the overall thickness of the actuator 202. Providing the pancake actuator 202, and providing either a thin back plate 234 or (preferably) incorporating the back plate into the strut 232, significantly increases compactness of the overall orthosis device 200. As a nonlimiting example, the complete subassembly 230 can have an overall thickness and weight that is less than the thickness of a commercial rotary actuator such as the rotary actuator 26 in the orthosis device 20.

Figure 21:
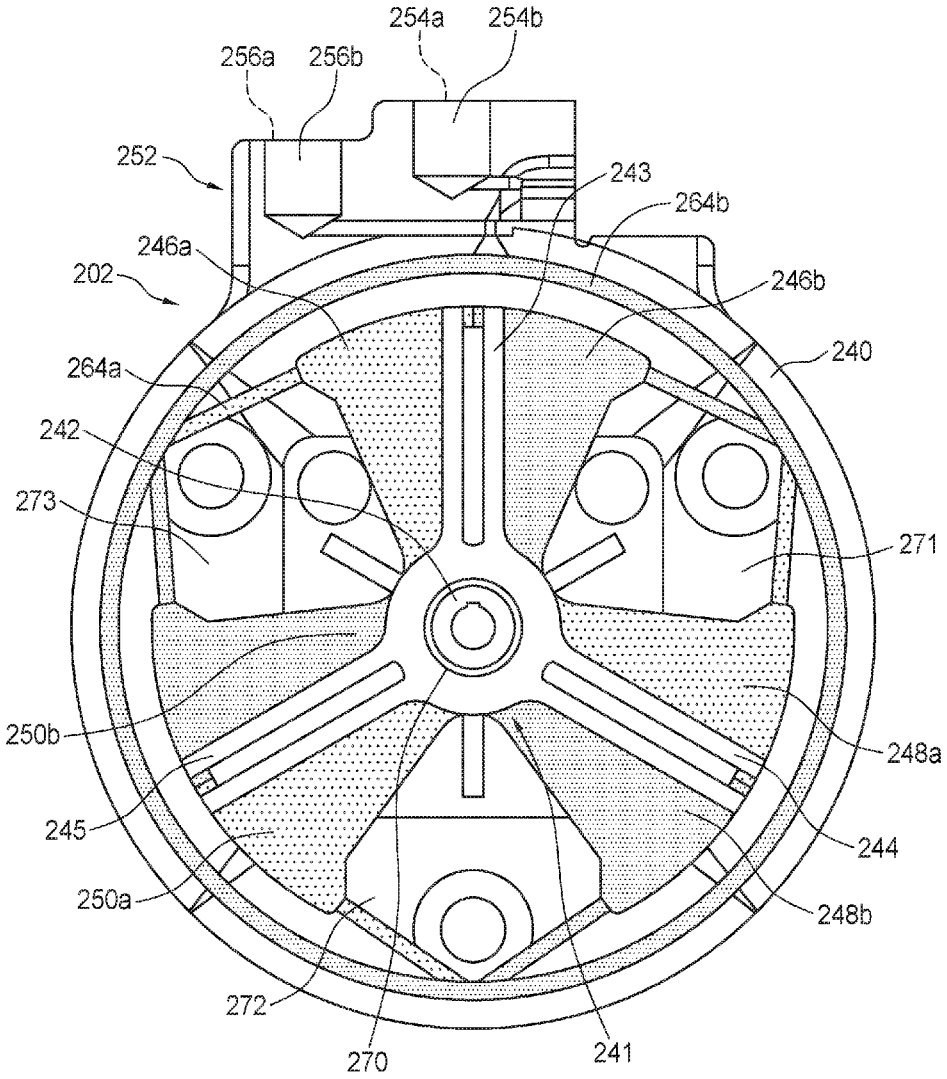
FIG. 21 is a rear view of a rotary actuator according to an embodiment of the present invention, with the back plate removed for clarity.
Figure 22:
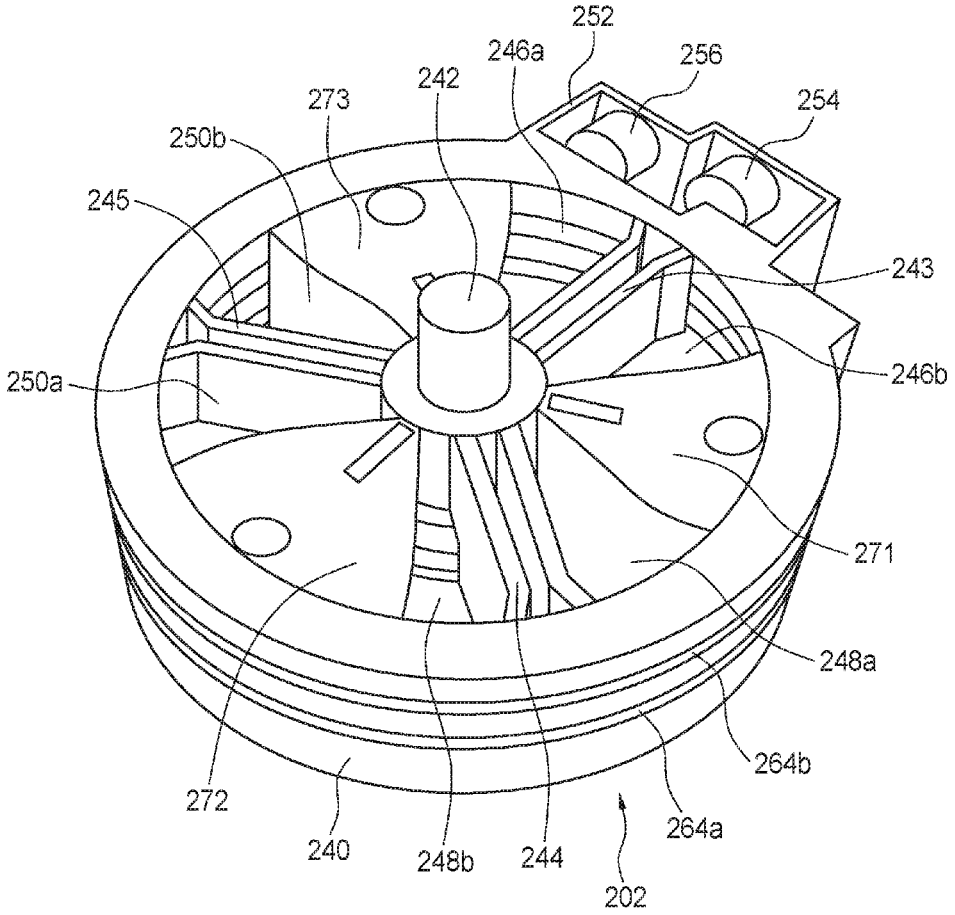
FIG. 22 is a rear perspective view of the rotary actuator of FIG. 21.
Figure 23:
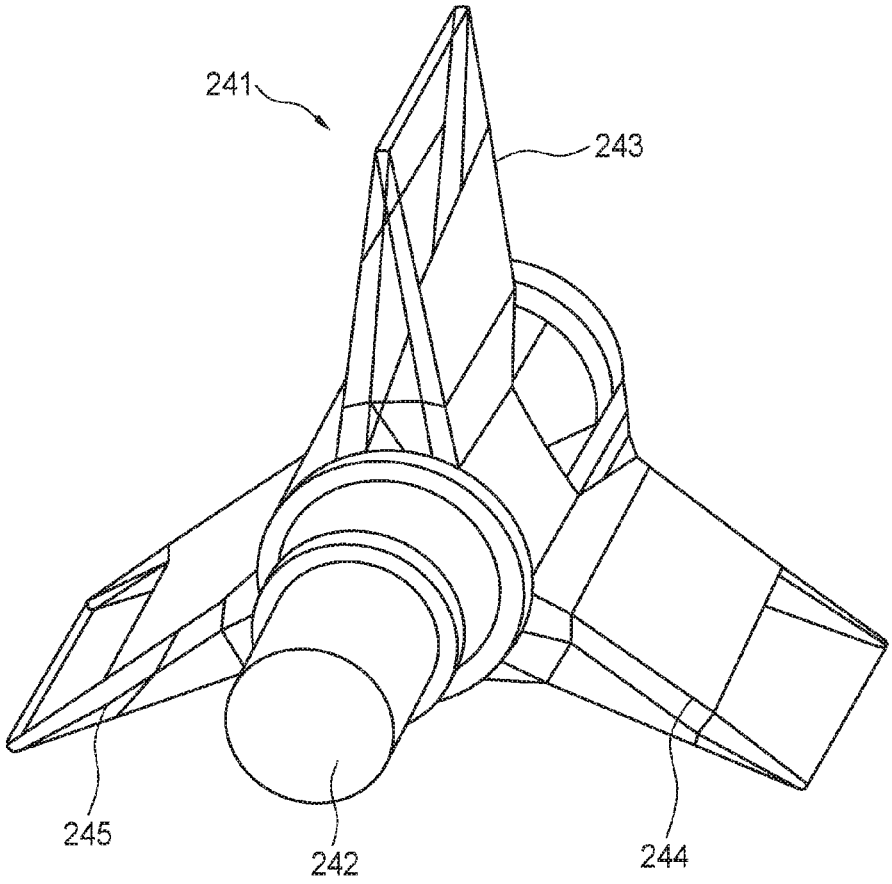
FIG. 23 is a perspective view of a triple vane for the rotary actuator of FIGS. 21-22.

As best seen in FIGS. 21-23, an example rotary actuator 202 is a triple vane pneumatic rotary actuator embodied in a pancake actuator (that is, it has a front-to-back thickness significantly smaller than its diameter). The rotary actuator 202 includes an outer housing (housing) 240 and a rotatable member, e.g., a rotatable triple vane 241 (best viewed in FIG. 23) disposed within the housing. "Rotatable" as used herein refers to being at least partially rotatable. The housing 240 and the triple vane 242 preferably are made of lightweight, sturdy material, such as but not limited to acrylic. Both the housing 240 and the triple vane 241 may be made of the same material (including composite materials) or of separate materials, and may each be formed as a unitary piece, or as separate components that are assembled.

To provide relative rotation between the lower leg mount 204 and the foot bed 206 the triple vane 241 includes a rotatable central shaft 242, which is fixedly coupled to the foot bed, for instance mounted to a portion of extension 233. The triple vane 241 further includes three disposed vanes 243, 244, 245, each of which divide openings in the housing 240 to define first chambers 246*a*, 248*a*, 250*a* and second chambers 246*b*, 248*c*, 250*c* on respective opposing sides of the vanes.

An upper portion 252 of the housing 240 is preferably formed with the housing to be unitary with the housing, but alternatively it may be a separate component that is mounted to the housing. Generally, the upper portion 252 includes integrated conduits and valves for selectively transporting fluid to the first chambers 246*a*, 248*a*, 250*a* and the second chambers 246*b*, 248*c*, 250*c*. For example, the upper portion 252 includes a front inlet port and a rear inlet port 256*a*, 256*b* (in FIG. 21, the rear inlet port is most clearly viewable), which are in fluid communication with front and rear fluid inputs 257*a*, 257*b* coupled to the inlet ports and disposed on and at least partially within the upper portion 252 of the actuator housing 240. Additional flow and noise control can be provided with metering valves with silencers, 255*a*, 255*b*, which are provided in an example embodiment (e.g., ASN2; SMC; Japan). The solenoid valves (260*a*, 260*b*) along with the additional flow control valves (255*a*, 255*b*) can be configured to manage force produced by the actuator 202. For instance, the valves (260*a* and 255*a*) can be used primarily to modulate plantarflexor torque, and the opposite pair of valves (260*b* and 255*b*) can be used primarily to modulate dorsiflexor torque.

Figure 20:
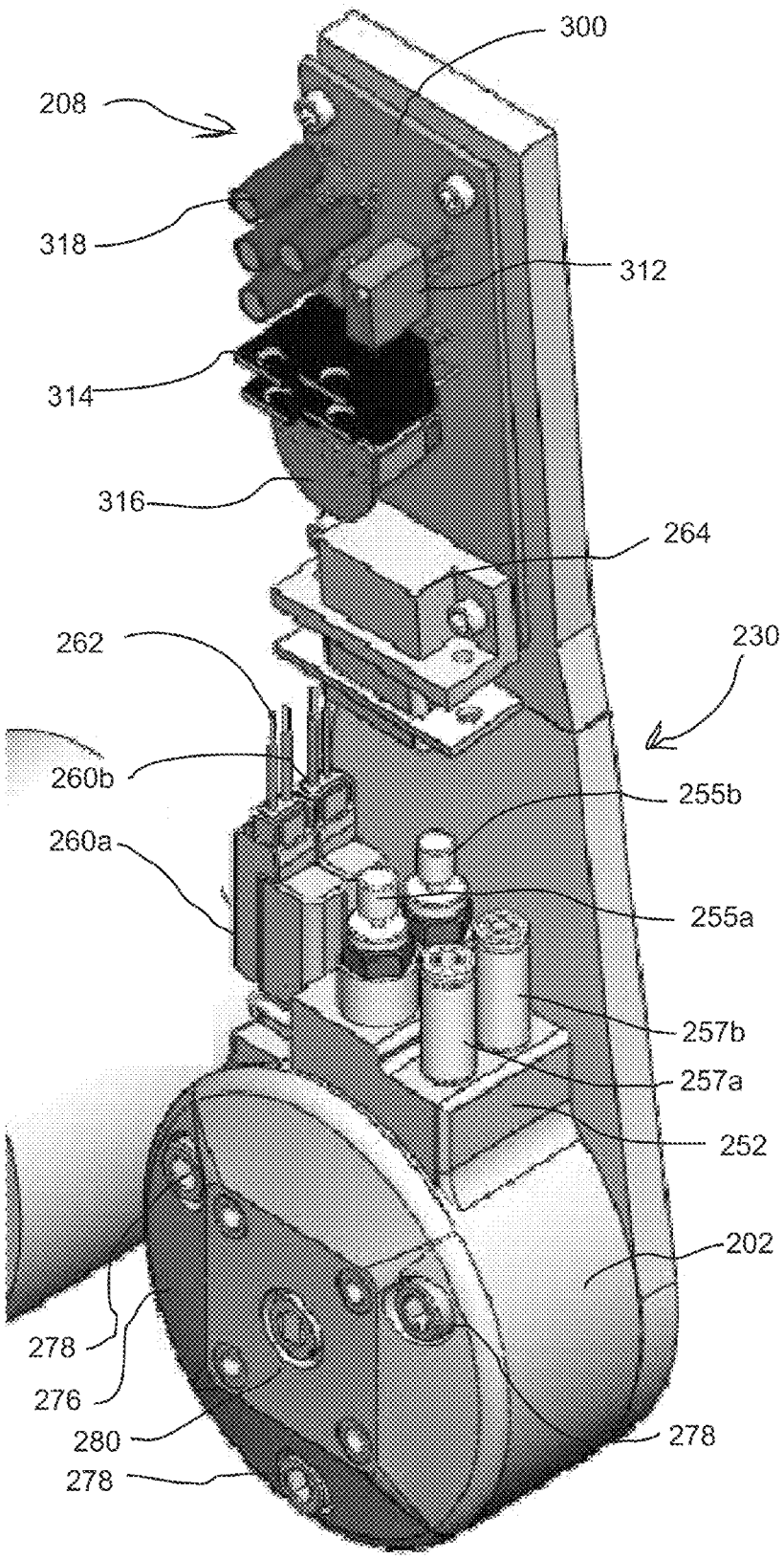
FIG. 20 is a perspective view of a subassembly for the orthosis device of FIGS. 15-19, with connections removed for clarity.

Front and rear valves, e.g., solenoid valves 260*a*, 260*b* are provided for controlling operation of the actuator 202. The solenoid valves 260*a*, 260*b*, as best viewed in FIG. 20, are preferably integrated with the upper portion 252 of the actuator housing 204 so that the upper portion provides a housing for the solenoid valves. In this way, both the solenoid valves 260*a*, 260*b* and the fluid regulators 255*a*, 255*b* are integrated with the actuator 202, reducing overall weight and increasing compactness of the device 200. The solenoid valves can be, for instance S070B-5DC; SMC; Japan. Instead of solenoid valves, proportional valves (preferably also integrated with the actuator housing 240) may be used.

The fluid power source (not shown in FIGS. 15-23), for instance a $CO_2$ or other suitable fluid container such as bottle 28, or by a homogeneous charge compression ignition (HCCI) compressor coupled to and disposed on a portion of the leg mount 204, can be coupled to and in fluid communication with the solenoid valves 260*a*, 260*b*, such as by coupling with fluid lines such as fluid lines 64, 65, 66 in the device 20. Directly integrating the solenoid valves 260*a*, 260*b* with the actuator 202 also reduces the number of additional fluid lines needed. Leads 262 electrically couple the solenoid valves 260*a*, 260*b* to an inlet/outlet 264 of the controller 208 for providing control signals. Fluid outputs of the solenoid valves 260*a*, 260*b* are in fluid communication with the fluid regulators 255*a*, 255*b* respectively, and in turn are in fluid communication with the front and rear inlet ports 256*a*, 256*b*, respectively. Thus, the front solenoid valve 260*a* controls fluid flow to the front inlet port 254*a* and the rear solenoid valve 260*b* controls fluid flow to the rear inlet port 254*b*.

For supplying fluid power to the actuator 202, the actuator housing 240 includes a front channel 264*a* and a rear channel 264*b* disposed in the housing. The front channel 264*a* fluidly couples the front inlet port 254*a* to the first chambers 246*a*, 248*a*, 250*a*. Similarly, the rear channel 264*b* fluidly couples the rear inlet port 254*b* to the second chambers 246*b*, 248*b*, 250*b*. The use of the valves (solenoid or proportional) enables the selective introduction of pressurized fluid to the actuator 202. The valving is used to control the torque supplied by the actuator by varying the relative fluid pressure between the first chambers 246*a*, 248*a*, 250*a* and the second chambers 246*b*, 248*b*, 250*b*. The differential pressure across the vane blades 243, 244, 245, generates torque at the shaft used to provide assistance with the device. Seals around the edges of the vane reduce leakage, but still allow vane movement. Operation of the valves 260*a*, 260*b* via the controller 208 can be performed as described above with respect to the device 20. The first chambers 246*a*, 248*a*, 250*a* and the second chambers 246*b*, 248*b*, 250*b* are also coupled to exit channels that are in turn coupled to the front and rear outlet ports 254*a*, 254*b*, respectively.

The shaft 242 is disposed in a bearing 270 for controlled rotation. Further, the housing 240 includes stops 271, 272, 273 symmetrically disposed within the housing to restrict clockwise and counterclockwise rotation of the triple vane 241 beyond a predetermined range. These stops 271, 272, 273 also at least partially define outer boundaries of the first and second chambers 246*a*, 248*a*, 250*a*, 246*b*, 248*b*, 250*b*.

Additionally, the face of the actuator body 240 is used to directly seal with the structural subassembly 230. The body of the actuator 240 can be fastened to the structural subassembly 230 via suitable fasteners 278. A seal, for example a silicone seal, may be disposed between the actuator body 240 and the structural subassembly 230.

Figure 18:
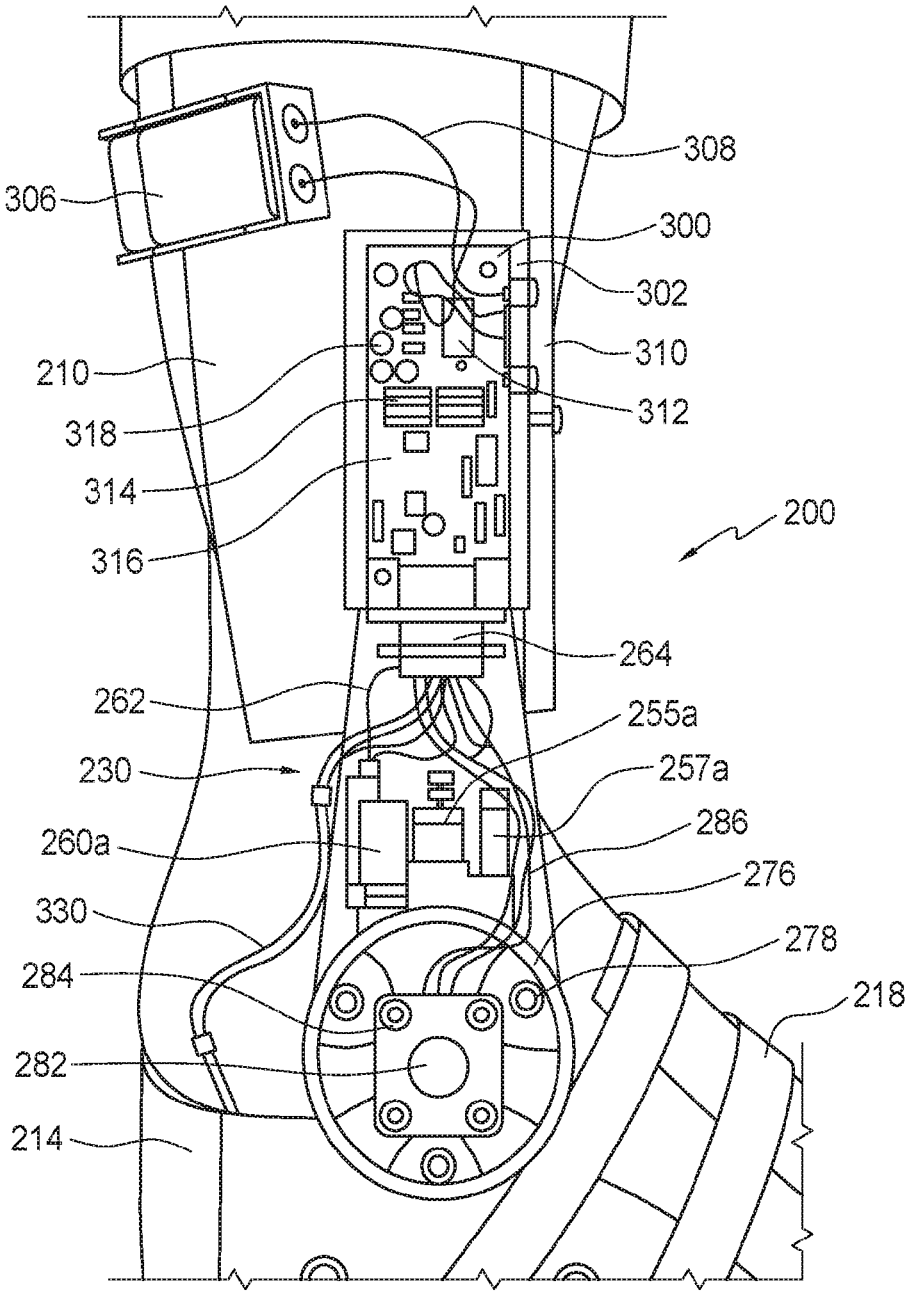
FIG. 18 is a side view of the orthosis device of FIGS. 15-17, including signal connections.
Figure 19:
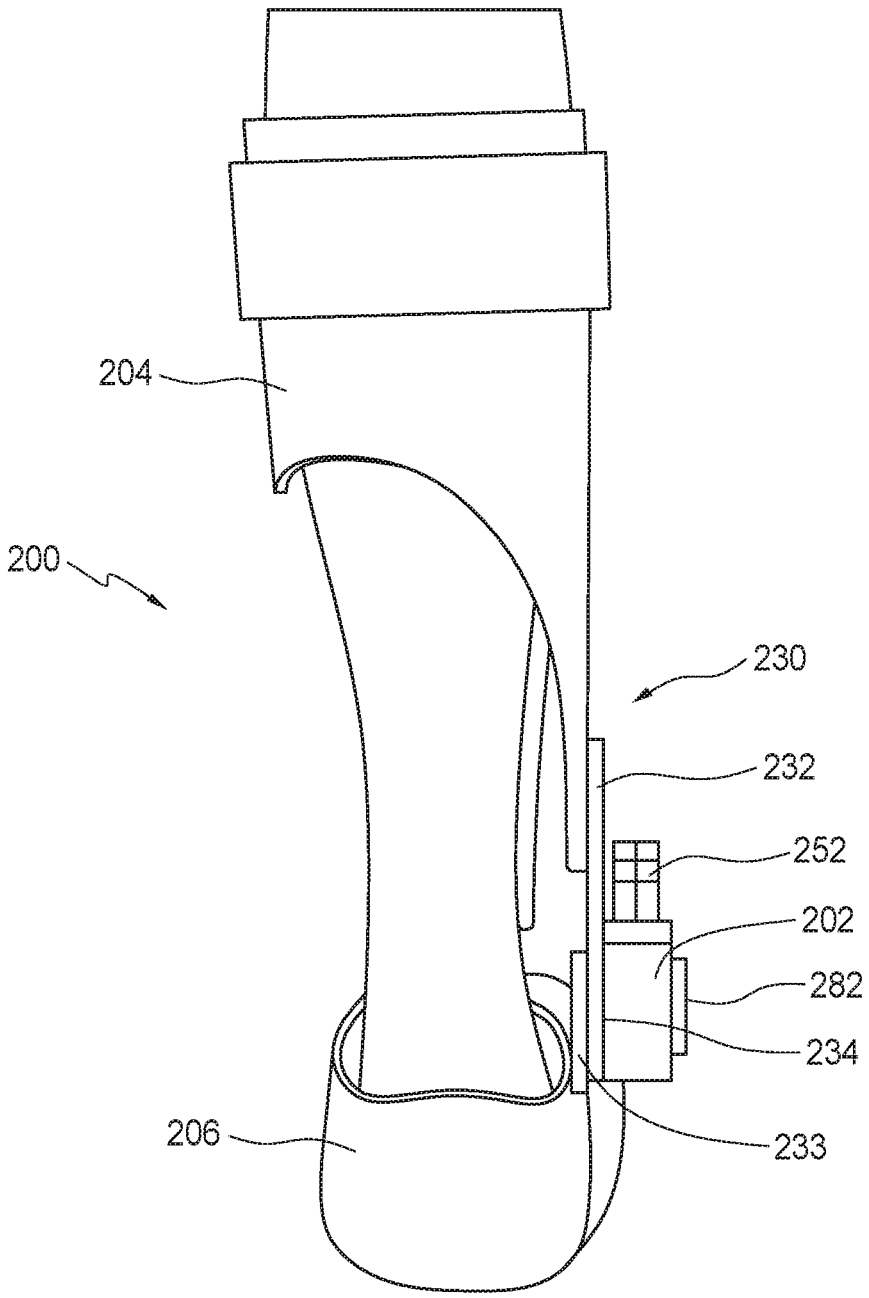
FIG. 19 is a rear perspective view of the orthosis device of FIGS. 15-18.

The front cover 276 preferably further includes an outer front plate 280 (see FIG. 20) for accommodating an angle sensor 282 (see FIGS. 17-18). Preferably, the angle sensor 282 has no moving parts. A preferred angle sensor 282 is a thin, non-contact rotary encoder, e.g., QR30; Dewitt Industrial Sensors; Netherlands, which is mounted to the outer front plate 280 via suitable fasteners 284. Leads 286 or other signal couplings (wired or wireless) are provided for providing signals from the angle sensor 282 for the controller 208. In other example embodiments, the angle sensor 282 (and leads 286) can be omitted.

Thus, in the example orthosis device 200, the solenoid valves 260*a*, 260*b*, metering valves with silencers, 255*a*, 255*b*, with suitable conduits, fluid outputs 257*a*, 257*b*, and the angle sensor 282 are integrated directly into the actuator housing 240. The electrical connections between the controller 208 and the solenoid valves 260*a*, 260*b* can also be disposed at least partially on or in the actuator housing 240. Further, the actuator 202 preferably is integrated directly into the structural sub-assembly 230, such as by incorporating a portion of the strut 232 for a back plate or by otherwise mounting a thin back plate to the strut. Thus, the example orthosis device 200 can weigh less and be smaller than other comparable devices, while also exhibiting increased efficiency.

The controller 208 is provided in an example embodiment on a circuit board 300 (e.g., a printed circuit board (PCB)) that is made sufficiently small as to be disposed on (and preferably fit entirely within) the surface of the strut plate 232. This circuit board 300 preferably is generally enclosed in a casing that is provided by a rear plate 302 (best viewed in FIG. 18) and a front cover 304, which may be vented. A battery 306 or other suitable power source (such as, but not limited to, the example power source 98) coupled to the circuit board 300 via suitable leads 308 supplies power to the controller 208 as will be appreciated by one of ordinary skill in the art. An on/off switch 310 is preferably provided on the circuit board 300.

Circuit components for the controller 208, including a microprocessor 316, and suitable electrical components 312, 314, 318 as well as the switch 310 and the input/output port 264, are integrated on the circuit board 300 as will be appreciated by one of ordinary skill in the art. Other components, for instance, for data logging capabilities, wireless communication for remote program changes and monitoring, etc., can also be provided. It will also be understood that the particular selection and arrangement of the circuit components for the controller 208 can vary, and the present invention is not intended to be limited to the particular controller shown.

The input/output port 264 mounted on the circuit board 300 provides output control signals to the integrated solenoid valves 260*a*, 260*b* via the leads 262. The input/output port 264 also receives input signals from the angle sensor 282 via leads 286. Further, leads 330 are provided for electrically coupling the input/output port 264 to force sensors such as the sensors 32, 34, 36 in the orthosis device 20. It is also contemplated that the signal leads 262, 330 could be omitted if the signals are transmitted wirelessly. It will further be appreciated that the input/output port 264 could include separate or integrated input and output ports.

As with the device 20, timing and magnitude for the orthosis device 200 can be determined uniquely for each participant through electronic and mechanical methods and devices/systems. For example, this can be accomplished using feedback from sensors, measurements from lab equipment, observation from investigators, and/or feedback from the participant to determine a subject specific control scheme that is downloaded to the microprocessor 312 embedded on the circuit board 300.

By providing a compact electronics package for the controller 208, the controller, the actuator 202, the solenoid valves 260*a*, 260*b*, the fluid regulators 255*a*, 255*b*, and the angle sensor 282, with suitable fluid conduits and signal couplings, can be integrated onto the strut 232 to provide the single, integrated subassembly 230. This complete subassembly 230 according to embodiments of the present invention can provide all aspects of the device's 200 functionality (e.g., other than the force sensing taking place underneath the user's foot) when provided with power for the controller 208 and fluid power for the actuator 202, yet this subassembly is lighter (as a nonlimiting example, 18 grams less) and thinner (as a nonlimiting example, 17% narrower) than some commercial rotary actuators. The subassembly 230, supported by the strut 232, also provides a modular solution for the active orthosis device 200, and could be integrated into other overall orthosis devices to provide controlled, active assistance. Operation of the orthosis device 200 is also made more efficient, and thus can be made more powerful, by integrating the components as shown and described in example embodiments. A nonlimiting example embodiment rotary actuator 202 produces 6.2 Nm of output torque given an input of 50 psi pneumatic pressure.

Example devices of the invention are lightweight and are configured, dimensioned, and arranged to be useable with many types of normal footwear and clothing. The lightweight design and compact, close-fitting nature of example devices also minimize the energetic impact to a user. Orthoses according to example embodiments of the invention are well-suited for at-home therapy and also for daily wear usage, because the devices are untethered and preferably lightweight. Example orthoses provide a treatment modality to improve the functional outcome of rehabilitation, diagnostic or training services, and/or laboratory studies.

While various embodiments of the present invention have been shown and described, it should be understood that other modifications, substitutions, and alternatives are apparent to one of ordinary skill in the art. Such modifications, substitutions, and alternatives can be made without departing from the spirit and scope of the invention, which should be determined from the appended claims.

Various features of the invention are set forth in the appended claims.

What is claimed is:

1. A portable active pneumatically powered ankle foot orthosis comprising:

a lower leg mount;

a foot bed pivotally configured to be coupled to said lower leg mount at or proximate to an ankle position;

at least one sensor for determining a phase of a user's gait;

a pneumatically powered rotary actuator coupled to said leg mount and to said foot bed, said rotary actuator being configured to receive power from a wearable fluid power source and to provide controlled force and/or resistance to aid or inhibit relative rotation of said foot bed and said lower leg mount; and a controller for receiving data from said at least one sensor and controlling said pneumatically powered rotary actuator to actively assist gait of a user wherein said pneumatically powered rotary actuator comprises a pancake actuator having a front-to-back thickness significantly smaller than its diameter;

wherein said rotatable member comprises a shaft coupled to at least one vane;

wherein said pneumatically powered rotary actuator comprises a plurality of openings disposed within said outer housing such that each of the least one vane is disposed within one of the plurality of openings to divide each of the plurality of openings into first and second fluid chambers;

wherein said pneumatically powered rotary actuator further comprises:

first and second fluid inputs integrated with said outer housing; and first and second fluid channels, wherein said first fluid channel fluidly couples said first fluid input with each of the first fluid chambers, and said second fluid channel fluidly couples said second input with each of the second fluid chambers.

2. The device of claim 1, further comprising:

at least one actuated valve for connecting to said wearable fluid power source and controlling fluid flow to said pneumatically powered rotary actuator;

said at least one actuated valve being responsive to said controller.

3. The device of claim 2, wherein said wearable fluid power source comprises a compact, wearable fluid power source coupled to said at least one valve and said pneumatically powered rotary actuator.

4. The device of claim 3, wherein said wearable fluid power source comprises a container housing a compressible fluid.

5. The device of claim 2, further comprising:

a pressure regulator coupled to said at least one actuated valve and to said pneumatically powered rotary actuator.

6. The device of claim 1, wherein said lower leg mount and said foot bed comprise a rigid, lightweight material selected from the group consisting of carbon fiber, carbon composite, light metal, and plastic.

7. The device of claim 1, wherein said controller is integrated with at least one of said lower leg mount and said foot bed;

wherein said controller comprises a microprocessor and a memory.

8. The device of claim 1, further comprising:

an angle rotation sensor for sensing an angle between said lower leg mount and said foot bed.

9. The device of claim 1, wherein said at least one sensor comprises at least one force sensor coupled to said foot bed for receiving a force applied to at least one portion of the foot bed and generating a signal.

10. A portable active pneumatically powered ankle foot orthosis comprising:

a lower leg mount;

a foot bed pivotally configured to be coupled to said lower leg mount at or proximate to an ankle position;

at least one sensor for determining a phase of a user's gait;

a pneumatically powered rotary actuator coupled to said lower leg mount and to said foot bed, said pneumatically powered rotary actuator being configured to receive power from a wearable fluid power source and to provide controlled force and/or resistance to aid or inhibit relative rotation of said foot bed and said lower leg mount, wherein said pneumatically powered rotary actuator comprises an outer housing, a rotatable member disposed within said outer housing, and at least one valve integrated with said pneumatically powered rotary actuator; and a controller for receiving data from said at least one sensor and controlling said pneumatically powered rotary actuator by controlling said at least one valve to actively assist the user's gait, wherein said pneumatically powered rotary actuator comprises a pancake actuator having a front-to-back thickness significantly smaller than its diameter;

wherein said rotatable member comprises a shaft coupled to at least one vane;

wherein said pneumatically powered rotary actuator comprises a plurality of openings disposed within said outer housing such that each of the least one vane is disposed within one of the plurality of openings to divide each of the plurality of openings into first and second fluid chambers;

wherein said pneumatically powered rotary actuator further comprises:

first and second fluid inputs integrated with said outer housing; and first and second fluid channels, wherein said first fluid channel fluidly couples said first fluid input with each of the first fluid chambers, and said second fluid channel fluidly couples said second input with each of the second fluid chambers.

11. The ankle foot orthosis of claim 10, wherein said at least one valve comprises at least one of a solenoid valve and a proportional valve.

12. The ankle foot orthosis of claim 10, further comprising:

a silencer disposed at least partially within said outer housing.

13. The ankle foot orthosis of claim 10, further comprising:

a front cover attached to and at least partially covering said outer housing.

14. The ankle foot orthosis of claim 13, further comprising:

an angle sensor integrated with said pneumatically powered rotary actuator;

wherein said angle sensor comprises a rotary encoder coupled to said front cover.

15. The ankle foot orthosis of claim 10, wherein said rotary actuator and said controller are fixedly coupled to a surface of a support structure to provide a subassembly;

wherein the subassembly is coupled to said lower leg mount;

wherein said rotary actuator, said controller, and said at least one valve are integrated on the subassembly.

16. The ankle foot orthosis of claim 15, wherein said controller comprises:

a circuit board disposed on a surface of the strut;

a processor disposed on said circuit board; and at least one of an input port and an output port disposed on said circuit board;

wherein said circuit board is sized to fit within the surface of the strut.

17. The ankle foot orthosis of claim 10, further comprising a strut coupling said lower leg mount to said pneumatically powered rotary actuator.

* * * * *